US005983577A

United States Patent [19]

Hays

[11] Patent Number: 5,983,577

[45] Date of Patent: Nov. 16, 1999

[54] LIGHT WEIGHT PRE-ENGINEERED PREFABRICATED MODULAR BUILDING SYSTEM

[75] Inventor: Gary David Amos Hays, Fort Smith, Ark.

[73] Assignee: Erecta Shelters, Inc., Greenwood, Ark.

[21] Appl. No.: 08/802,815

[22] Filed: Feb. 19, 1997

[51] Int. Cl.[6] ..... E04B 1/32; E04B 1/19

[52] U.S. Cl. ..... 52/79.1; 52/92.2; 52/92.3; 52/93.1; 52/640; 52/641; 52/646; 52/653.2; 52/655.1; 52/693

[58] Field of Search ..... 52/79.1, 92.2, 52/92.3, 93.1, 93.2, 640, 641, 646, 653.2, 655.1, 693

[56] References Cited

U.S. PATENT DOCUMENTS 3,785,108 1/1974 Satchell ..... 52/641 X
4,170,852 10/1979 Danis et al. ..... 52/641 X
4,312,160 1/1982 Wilbanks ..... 52/639 X
4,930,268 6/1990 Fritz et al. ..... 52/639 X
5,372,448 12/1994 Gilb ..... 52/280 X

*Primary Examiner*—Christopher T. Kent
*Attorney, Agent, or Firm*—Jerry L. Mahurin

[57] ABSTRACT

A Lightweight Pre-engineered prefabricated modular Building System comprised of nine pre-fabricated structural members and three prefabricated connectors which create the entire building main frame system. A multiple use principal structural member is utilized as columns and top and bottom cords as well as end rungs for trusses and truss legs. The connectors are right angle connectors; each employing a configuration of holes and slots for securing structural members to create a rigid attachment of rafters to columns. The same connectors can be employed to establish a shallow pitch or a steep pitch roof pitch through selection of the holes and slot positions used to bolt the structural frame together. Trusses are interchangeable anywhere in system. Eave peak members, purlins and girts are used to attach sheathing to the structural frame. Alternatively, a "V" shaped stiffener can be employed with the columns.

18 Claims, 18 Drawing Sheets

100
110
115
125
130
135
140
185
215
245
350
390
400

LIGHT WEIGHT PRE-ENGINEERED PREFABRICATED MODULAR BUILDING SYSTEM

BACKGROUND OF THE INVENTION

1. Technical Field

The present invention broadly relates to a building system. Specifically the present invention is a light weight pre-engineered prefabricated modular building system. Art pertinent to the subject matter of the present invention can be found in various Subclasses of United States Patent Class 52.

2. The Prior Art

Numerable patents have been issued on modular building systems and components used in such systems. For example, many patents have been issued on building trusses. Pomento, U.S. Pat. No. 4,854,104, discloses a wooden truss member intended to connect a column and roof beam. Sheppard, U.S. Pat. No. 4,616,453, discloses a light gauge steel building system and truss design. Wilbanks, U.S. Pat. No. 4,312,160, discloses a truss assembly employing criss-crossed struts extending from a column to a mid point of an opposite rafter. Wormser, U.S. Pat. No. 3,462,895, discloses a symmetrical shelter truss commonly used for pavilions and the like. Davenport, U.S. Pat. No. 4,435,940 discloses a metal building truss employing top and bottom cords made of channel iron material. Funk, U.S. Pat. No. Des. 297,864, discloses a bolt together truss assembly employing channel iron members. Dividoff, U.S. Pat. No. 4,748,784, discloses a triangulated roof truss structure.

Many building systems employ specialized brackets for establishing joints between standardized, dimensional structural members. Brackets formed from sheet metal are popular for joining dimensional lumber. Such brackets are disclosed in Gilb, U.S. Pat. No. 5,372,448 and Southerland, U.S. Pat. No. 4,335,555. Two patents issued to Fritz, U.S. Pat. Nos. 4.9041,496 and 4.930,268 disclose building brackets. The former is a two piece roof peak bracket and the latter a two piece post to roof beam bracket. Andrews, U.S. Pat. No. 4,773,192, discloses brackets used to connect structural members with interlocking or indexing shapes. Dufour, U.S. Pat. No. 4,974,387, discloses a prefabricated joint used to join steel trusses and dimensional steel members. McElhoe, U.S. Pat. No. 4,041,659 discloses a metal building structure employing tabs and brackets for securing structural steel members. Hale, U.S. Pat. No. 4,809,480 discloses a set of brackets used to join rafters, at the peak, to the columns and the columns to a supporting surface. Solo, U.S. Pat. No. 4,381,635, discloses a truss support system using a hinged or pivoted connector. Brown, U.S. Pat. No. 3,717,964 discloses a modular building frame system employing indexing tabs and stops to facilitate assembly. Matticks, U.S. Pat. No. 5,993,725 discloses a building comprised of interlocking components which employs few fasteners. Reid, U.S. Pat. No. 4,049,082, discloses a structural frame member. Geraci, U.S. Pat. No. 3,674,589, discloses a trihedrial clip and a variety of uses for the clip in steel frame construction.

The building industry has striven to provide a readily customizable building design. For example, Dean, U.S. Pat. No. 5,465,487, discloses a method for forming a rigid frame for construction.

The present Inventor previously developed a lightweight steel building system that utilized square steel tubing and five-sided ductile iron connectors. These connectors allow tubular structural members to attach from needed directions to create buildings in various sizes and configurations. A company founded by the present Inventor, Erecta Shelters, Inc. of Greenwood, Ark., has sold, designed, manufactured, and erected thousands of buildings using this tubing and ductile iron connector design.

The greatest demand for general purpose buildings is for sizes of fifteen to fifty feet in width, with eight to fourteen foot side wall heights, and lengths from twenty four to sixty feet. A large majority of these buildings are erected by the people who purchase them, not professional builders. This "Do It Yourself" trend is constantly increasing. The "Do It Yourself" portion of the building industry is undoubtedly the fastest growing part of the industry.

There are over one hundred steel building manufacturers in the United States; and customarily, lead time to fabricate a building is five to eight weeks. No manufacturer presently offers a pre-engineered prefabricated building available on the on the same day that the building is ordered.

SUMMARY OF THE INVENTION

My light weight pre-engineered prefabricated modular building system allows construction of a building employing easily inventoried interchangeable connectors, structural members, and components capable of producing multiple gable wall heights, widths and configurations. Roof designs include double pitch, cantilever, and single pitch. Building lengths are independent from the gable, wall and roof design chosen. This novel modular building system, emphasizes simplicity of erection, longevity of product, insurability, customer service, affordability, mass production and mass distribution. Buildings built using the present system are insurable at a lower rate than conventional wooden or wood-masonry structures.

The modular system is comprised of nine pre-fabricated structural members and three connectors which create the entire building main frame system. The connectors make it possible to change roof pitch from a shallow pitch such as a two in fifteen ratio to a steep pitch such as a four in fifteen ratio utilizing the same connectors and structural members. This capability is extremely important for northern structures with heavy snow load requirements.

An integral part to my system is a multi-use principal structural member which is utilized as columns and exterior supports for open web rigid frame members (trusses). The truss designs are interchangeable anywhere in the modular concept resulting in larger open span capabilities.

Typical bay lengths are twelve, fifteen, eighteen and twenty-one feet using four inch members and connectors. Building load and wind requirements vary in different regions with each region having multiple load conditions for commercial, residential and agricultural. Various bay lengths may be utilized to meet required loadings resulting in the most affordable application. Increased bay lengths result in reduced cost per square foot. Proportionally larger members and connectors can be employed for larger scale applications providing greater open spans and wall heights. Conversely, proportionally smaller scale members and connectors can be used to construct smaller structures from storage buildings to play houses to model or toy building sets.

This building system lends itself to mass production and distribution. Due to its numerous configurations and applications utilizing so few components, this pre-engineered prefabricated modular building system can be carried as an "in-stock" item by dealers, distributors and/or franchisees.

Therefore, a primary object of the present invention is to provide a light weight pre-engineered prefabricated modular building system.

Specifically, an object of the present invention is to provide a modular building system which allows construction of a building employing easily inventoried interchangeable connectors, structural members, and components.

An object of the present invention is to provide a light weight pre-engineered prefabricated modular building system capable of producing multiple gable wall sizes and configurations.

An object of the present invention is to provide a modular building system which provides a choice of roof designs including double pitch, cantilever, and single pitch.

A related object of the present invention is to provide a modular building system.

Another object of the present invention is to provide a modular building system in which building length is independent of the gable, wall and roof design.

Another object of my modular building system is to provide a simple to erect building which is conducive to use by a do-it-yourself builder.

Another object of the present invention is to provide an affordable modular building system.

Another object of the present invention is to provide a modular building having a long life span.

An object of the present invention is to provide a modular building system capable of being mass produced and mass distributed.

Another object of the present invention is to provide a modular building system capable of being configured in a shallow pitch or a steep pitch roof configuration utilizing the same structural members and connectors.

A related object of my modular building system is to provide the capacity to deal with various load conditions.

Specifically, an object of my modular building system is to provide the capacity to deal with heavy snow loads.

An object of the present invention is to provide a modular building system which utilizes a principal structural member as columns and truss cords.

A related object of my modular building system is to provide a truss design which is interchangeable and configurable for use anywhere in the building.

An object of my modular building system is top provide a truss configuration wherein all truss legs and roof trusses are interchangeable.

An object of the present invention is to provide a modular building system in which increasing the thickness of connectors and structural members will increase load capabilities.

An object of the present invention is to provide a modular building system which is faster and easier to erect making it more conducive to use by contractors.

An additional object of the present invention is to provide a modular building system is to provide a building system conducive to use by minimum skilled laborers.

An object of the present invention is to provide a modular building system well suited for use for disaster relief situations requiring immediate delivery.

An object of the present invention is to provide a modular building system that may be easily disassembled and reassembled with no loss of materials.

A related object of my building system is to provide a building system well suited for use by the oil and gas industry in covering field compressors in compliance with storm water run off laws.

An object of the present invention is to provide a modular building system which is capable of multiple uses, specifically in commercial, residential and agricultural applications.

An object of the present invention is to provide a modular building system which is conducive to use by the armed services.

An object of the present invention is to provide a modular building system which is capable of building cities in third world countries.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figures 1, 2, 3:
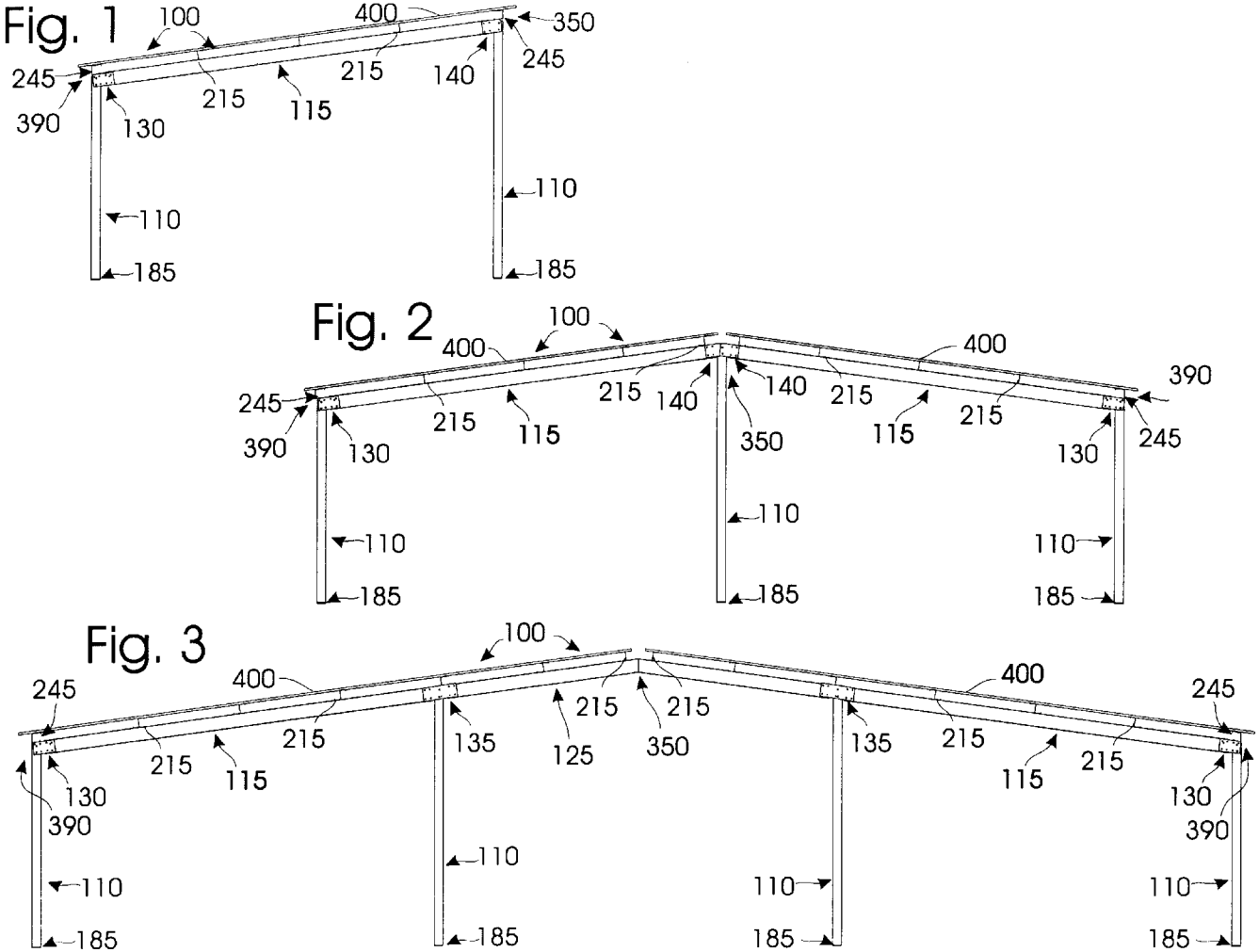
FIG. 1 is a front elevational view of a single pitch building frame constructed using my light weight pre-engineered prefabricated modular building system partially fragmented to expose the connectors for clarity.
FIG. 2 is a partially fragmented front elevational view of a double pitch, center column building frame constructed using my light weight pre-engineered prefabricated modular building system.
FIG. 3 is a partially fragmented front elevational view of a double pitch building frame constructed using my light weight pre-engineered prefabricated modular building system with the prefabricated double pitch rafter.

With reference now to the accompanying drawings. the preferred embodiment of my lightweight pre-engineered prefabricated modular building system 100 is broadly designated by the reference numeral 100.

Application of the structural members and connectors making up the system 100 results in a rhythm that is embodied by a modular building system 100 producing numerous building sizes using relatively few components. The present building system 100 is simple, strong and cost effective.

The width of bays in the present system 100 is based directly on the structural member size. Based on engineering data by the Light Gage Structural Institute established in 1990, and the Light Gage Structural Steel Framing System Design Handbook, four inch columns are best suited to fifteen foot bays; six inch columns are best suited to twenty-one foot bays; and eight inch columns are best suited to twenty-seven foot bays; all with various gable widths.

Generally, reference is made to the four inch system throughout this disclosure as illustrative of the system 100. The four inch system consist of nine structural members: eight, ten, twelve, fourteen, sixteen and eighteen feet columns 110, a fifteen foot single pitch rafter 115, a fifteen foot shallow pitch (two in fifteen pitch) double pitch rafter 125, a fifteen foot steep pitch (four in fifteen pitch) double pitch rafter 120; and three connectors: an eave connector 130, a rafter connector 135 and a peak connector 140.

The columns 110 are constructed from a principal structural member 142. The member 142 is generally tubular. The illustrated second embodiment employs a longitudinal notch 145. Therefore, the illustrated structural member 142 has a generally closed "C" shaped cross-section. FIGS. 10 through 13. The dimensions and thickness of the principal structural member 142 is dependent on load requirements, length of spans, or building height. Generally speaking, the principal structural member 142 is either rectangular or square. For practical concerns it will generally be square. The width of the notch 145 for notched members is determined by load requirements. lengths of spans and/or height.

This principal structural member 142 is utilized as a column 110 (FIGS. 10 through 13) and as top and bottom cords 150 and 155 for trusses 160 (FIGS. 33 and 34) in the present system 100. When notched members 142 are used as a column 110 or vertical support, the notch 145 allows access to attach girts 162 and framed openings. Two holes 165 on the side 170 of the column 110 opposite the notch 145, at the top extent of the column 110, are provided to attach a connector 130, 135 or 140 using nuts 175 and bolts 180 on the exterior of the column 110. A base plate 185 is welded to the bottom of a column 110. The base plate 185 protrudes past the side 190 defining the notch 145. "Eave and rafter connectors 130 and 135 are also bolted in place within the interior of the open end of a double pitch rafter 120 or 125." Two holes 195 are defined in the protruding portion 197 of the base plate to receive anchor bolts. Preferably, columns 110 are pre-marked at appropriate girt 162 and framed opening heights or girt brackets are pre-welded at the appropriate heights. When used as truss cords 150 and 155, the width of the notch 145 of a notched principal structural member 142 is determined by load requirements, lengths of spans and/or height, as well as size and attachment method of intermediate web members.

Figure 16:
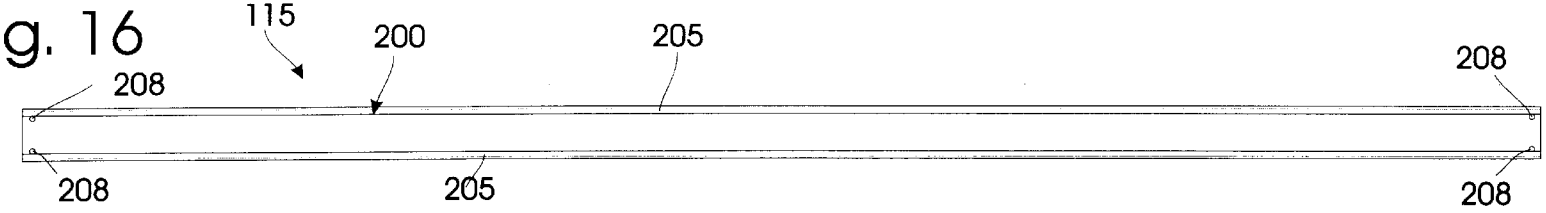
FIG. 16 is a front elevational view of a rafter employed in the modular building system.
Figure 17:
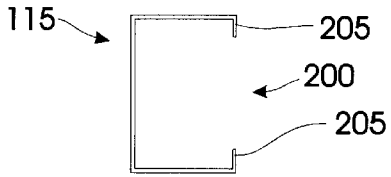
FIG. 17 is a greatly enlarged end elevational view of a rafter.

The rafters 115 employed in this system 100 are generally rectangular with one mostly open side 200. Therefore, the rafters 115 define a generally "C" shaped cross section with a larger opening than the principal structural members 142. See FIGS. 16 and 17. For example in the four inch system 100, the rafter 115 is formed of six inch by four inch channel having a pair of one inch return legs 205. Material thickness for rafters 115 is determined by load conditions. Rafter 115 are pre-punched or drilled with attachment holes 208 for interior connector 130, 135 and 140 attachment; and exterior purlin 210 attachment.

The three connectors 130, 135 and 140 are an integral part of the connectors 130, 135 and 140 are right angle connectors; each employing a configuration of holes and slots for securing structural members to create a rigid connection of rafters 115 to columns 110. The same connectors 130, 135 and 140 can be employed to establish a shallow pitch or a steep pitch roofline configuration. Alternatively, a shallow pitch roof line may be utilized on one side of a double pitch or cantilever building with the other side utilizing a steep pitch roofline, thereby, creating a gable configuration of both shallow and steep combination pitch. The connectors 130, 135 and 140 are bolted in place on the exterior of the upper extent of columns 110 and within the interior of rafter ends.

Figure 4:
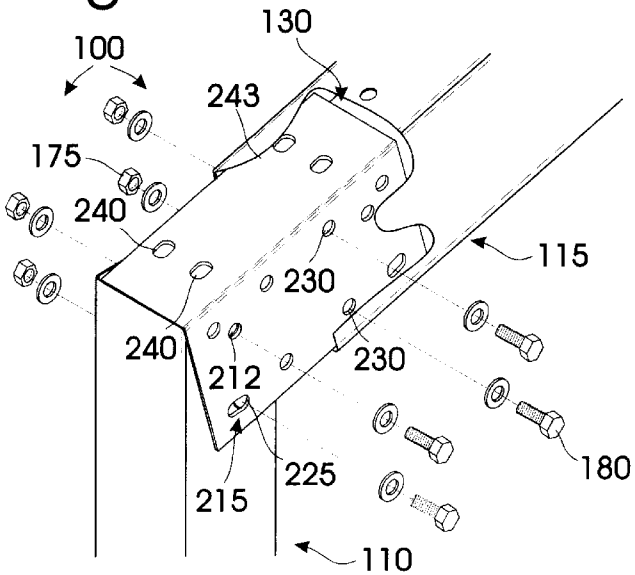
FIG. 4 is a partially fragmented, partially exploded, isometric view of an eave connector joining a column and a rafter in a shallow pitch configuration.
Figure 7:
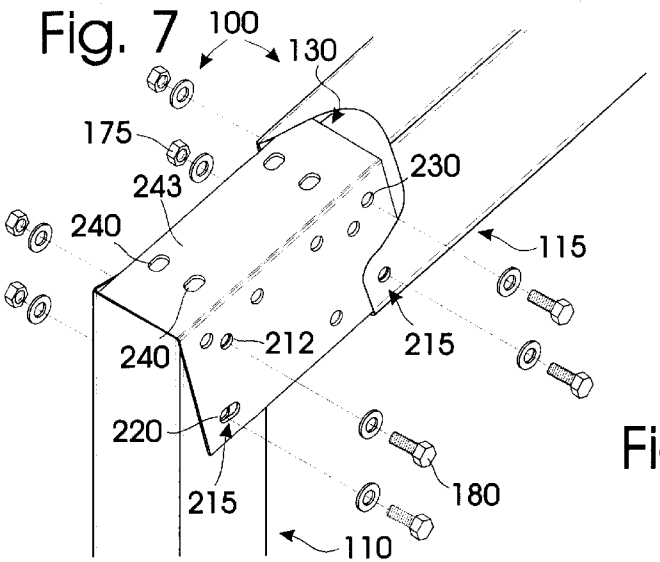
FIG. 7 is a partially fragmented, partially exploded, isometric view of an eave connector joining a column and a rafter in a steep pitch configuration.
Figure 10:
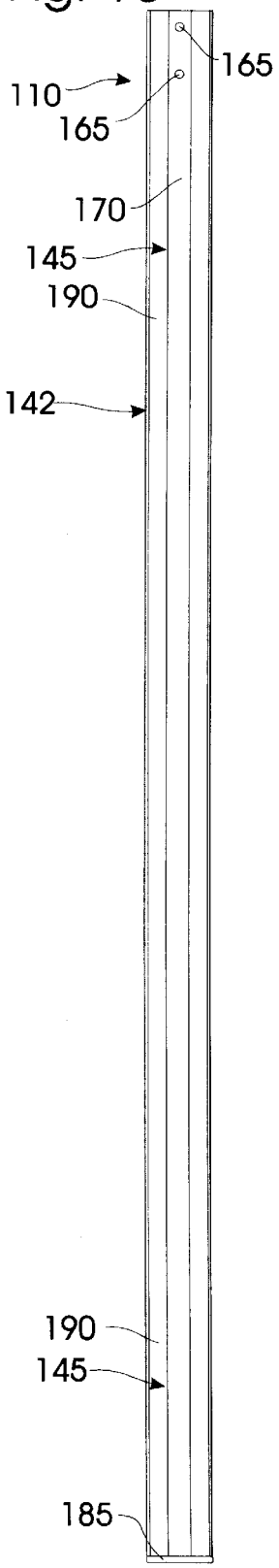
FIG. 10 is a front elevational view of the principal structural member employed by my modular building system in a column configuration.
Figure 11:
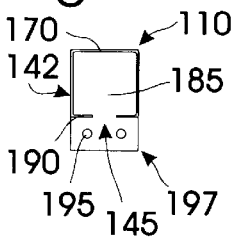
FIG. 11 is a top plan view of the principal structural member column.
Figure 12:
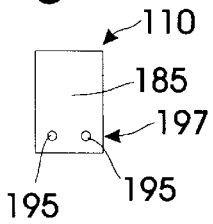
FIG. 12 is a bottom plan view of the principal structural member column illustrating the column base plate.
Figure 13:
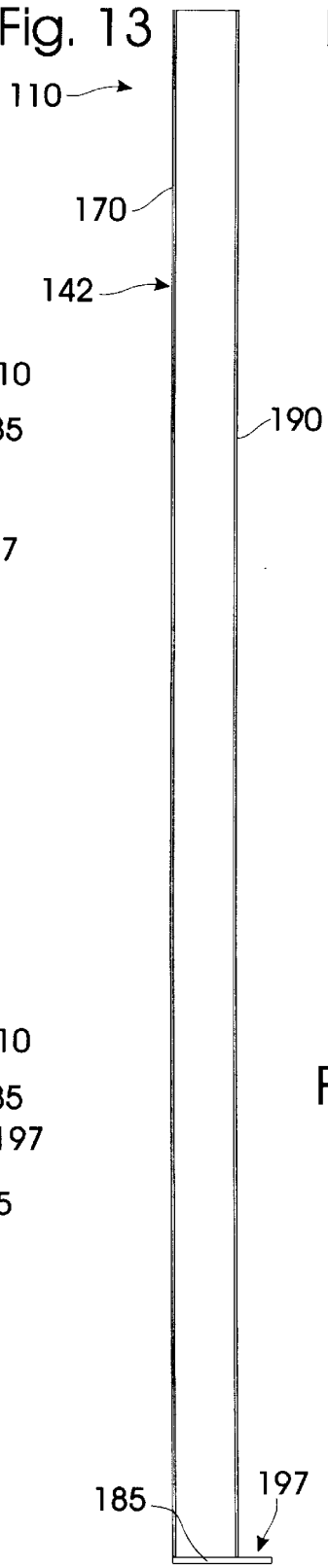
FIG. 13 is a side elevational view of the principal structural member column.

An eave connector 130 is bolted to the top portion of a column 110. FIGS. 19 through 22. A single eave connector 130 design is employed by the present system 100 as both left and right connectors. Each end portion of an eave connector 130 is a mirror image of the other end. With attention directed to FIGS. 4 and 7, in use one bolt 180 is placed through a pivot hole 212, and one bolt 180 will be placed through a pitch slot 215. The eave connector 130 will be securely tightened to the column 110 in the shallow pitch configuration utilizing the inside portion 225 of the pitch slot 215. The steep pitch is achieved by utilizing the outside portion 220 of the same pitch slot 215. To attach rafters 115 in the shallow pitch configuration one utilizes the shallow pitch rafter holes 230. FIG. 4. To attach rafters 115 in the steep pitch configuration the steep pitch rafter hole 235 and the unused pitch slot 215 are used. FIG. 7. Holes 240 in the top portion 243 of the eave connector 130 are used for eave-peak strut 245 attachment.

Figure 6:
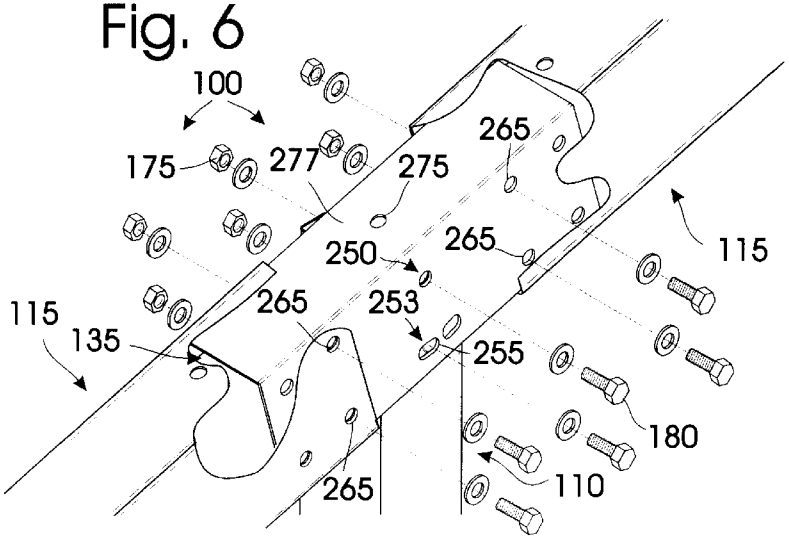
FIG. 6 is a partially fragmented, partially exploded, isometric view of a rafter and column connector joining a column and a pair of rafters in a shallow pitch configuration.
Figure 9:
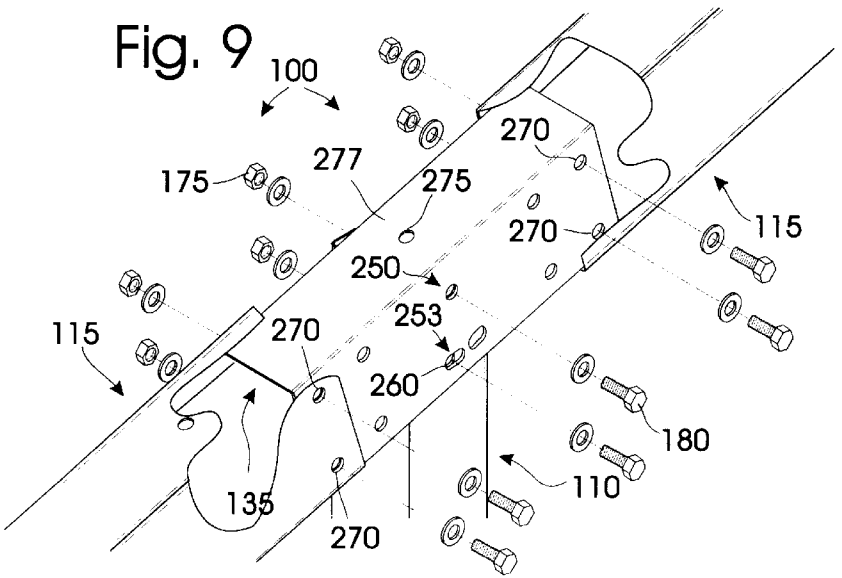
FIG. 9 is a partially fragmented, partially exploded, isometric view of a rafter and column connector joining a column and a pair of rafters in a steep pitch configuration.

A second connector employed by the present system 100 is a rafter connector 135 FIGS. 27 through 30. The rafter connector 135 is also bolted to the top portion of a column 110. FIGS. 6 and 9. Once again one bolt 180 is placed through a pivot hole 250. A pitch bolt 180 is placed through a pitch slot 253. The connector is secured to the column 110 in a shallow pitch by utilizing the inside portion 255 of the pitch slot 253. FIG. 6. The steep pitch is achieved by utilizing the outside portion 260 of the same pitch slot 253. FIG. 9. Rafters 115 are attached in a shallow pitch by utilizing the shallow pitch rafter holes 265. FIG. 6. In the steep pitch the steep pitch rafter holes 270 are used to attach rafters 115. FIG. 9. A purlin 210 attachment bolt hole 275 is defined in the top 277 of the rafter connector 135. A single rafter connector 135 design is employed by the present system 100 as both left and right connectors. The outsidemost pitch slot 253 is used in each instance.

Figure 5:
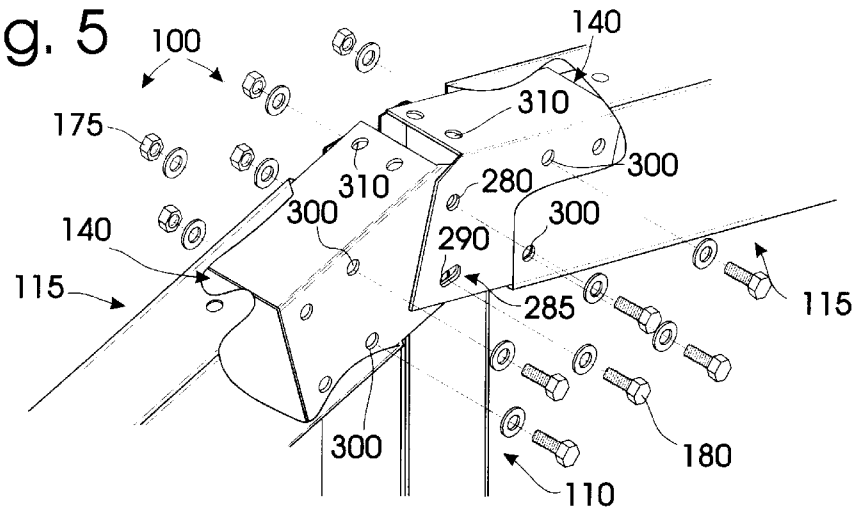
FIG. 5 is a partially fragmented, partially exploded, isometric view of a peak and column connector joining a column and a pair of rafters at the peak of a building with a shallow pitch roof.
Figure 8:
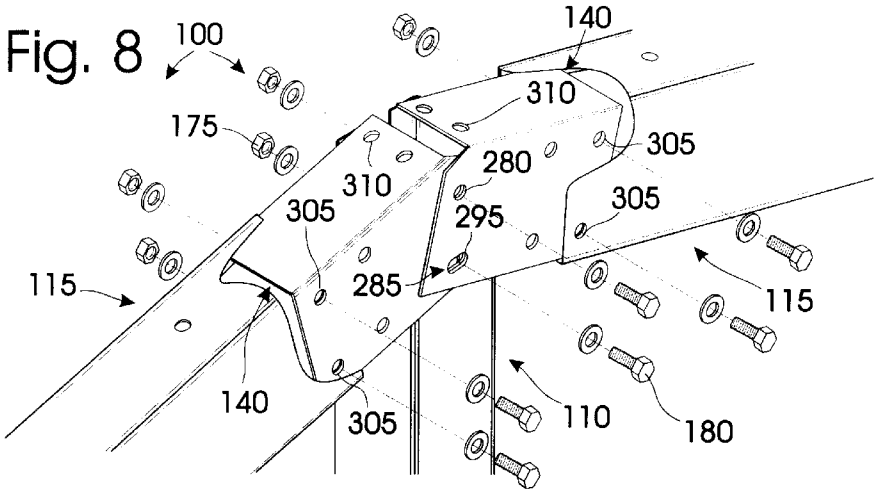
FIG. 8 is a partially fragmented, partially exploded, isometric view of a peak and column connector joining a column and a pair of rafters at the peak of a building with a steep pitch roof.

A third connector employed by the present system 100 is the peak connector 140. FIGS. 23 through 26. One peak connector 140 is utilized in single pitch buildings (FIG. 1). Two peak connectors 140 are utilized for double pitch, center columned (FIG. 2) and cantilevered buildings (FIG. 2). As seen in FIGS. 5 and 8, these left and right peak connectors 140 are mirror images of each other. As illustrated in FIGS. 5 and 8, the peak connector 140is also bolted to the top portion of a column 110. 280 and a second bolt 180 through the pitch slot 285. In a shallow pitch building the outside portion 290 of each pitch slot 285 is utilized (FIG. 5), and in a steep pitch the inside portion 295 of the same pitch slots 285 are employed (FIG. 8). To attach rafters 115 in the shallow pitch configuration, the shallow pitch rafter holes 300 are used. FIG. 5. To attach rafters 115 in the steep pitch configuration the steep pitch rafter holes 305 are used. FIG. 8. A pair of holes 310 defined in the top 312 of the peak connector 140 near the inside edge allows attachment of a eave-peak strut 245 on the high side of single pitch buildings. When two peak connector 140s are utilized in a double pitch and cantilever pitch buildings, the peak strut holes 310 are not utilized.

A double pitch rafter 120 or 125 is employed in double pitch buildings (FIG. 3) which do not employ center columns 110 and in double pitch cantilevered buildings. The double pitch rafter 120 or 125 is a prefabricated, rigid member used to form open peaks 350. Preferably, the double pitch rafters 120 and 125 are formed of the same material as the rafters 115 and the joint 312 at the peak 350 is welded.

Figure 18:
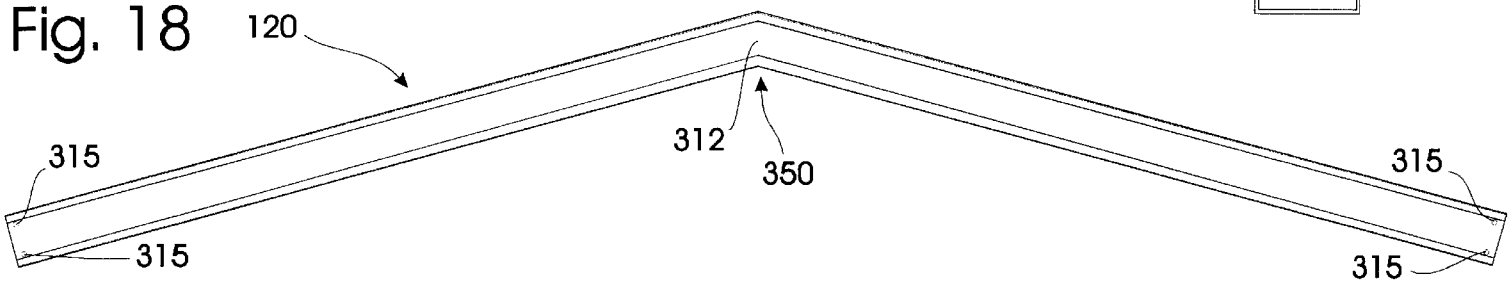
FIG. 18 is a front elevational view of a steep pitch double pitch rafter employed in the modular building system.
Figure 18A:
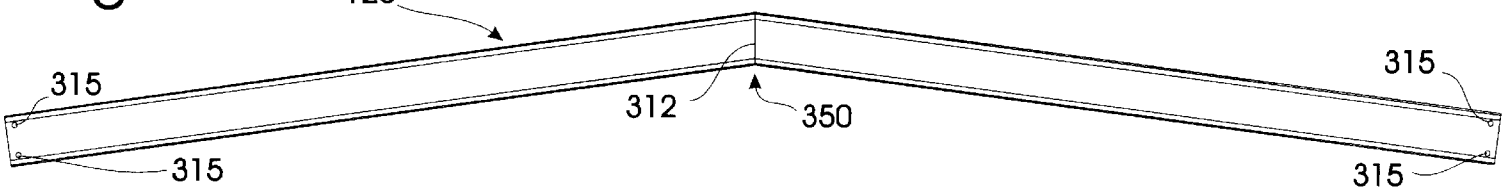
FIG. 18A is a front elevational view of a shallow pitch double pitch rafter employed in the modular building system.
Figure 20:
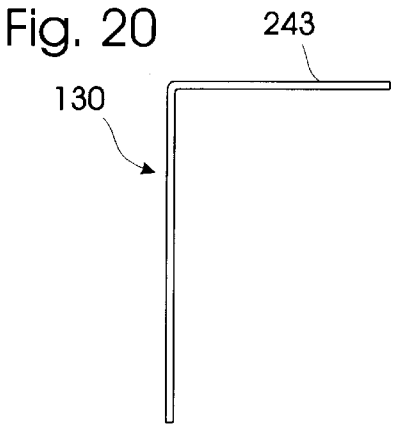
FIG. 20 is an end elevational view of the eave connector.
Figure 22:
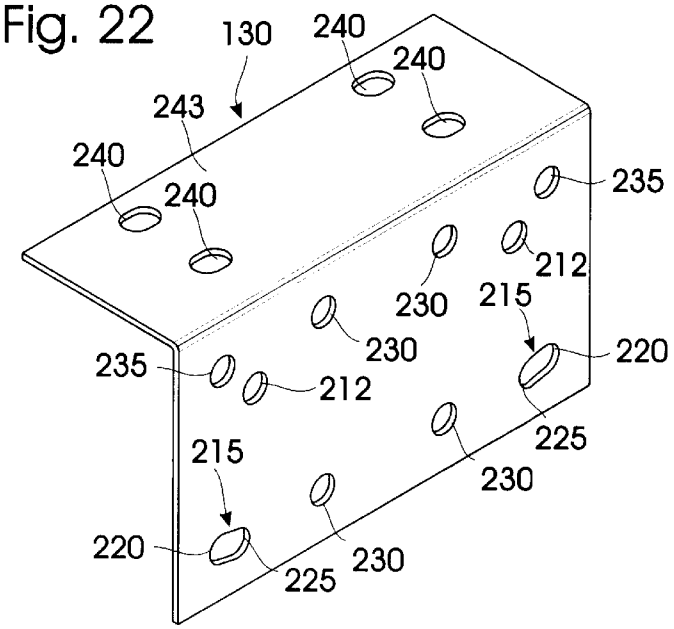
FIG. 22 is an isometric view of the eave connector
Figure 19:
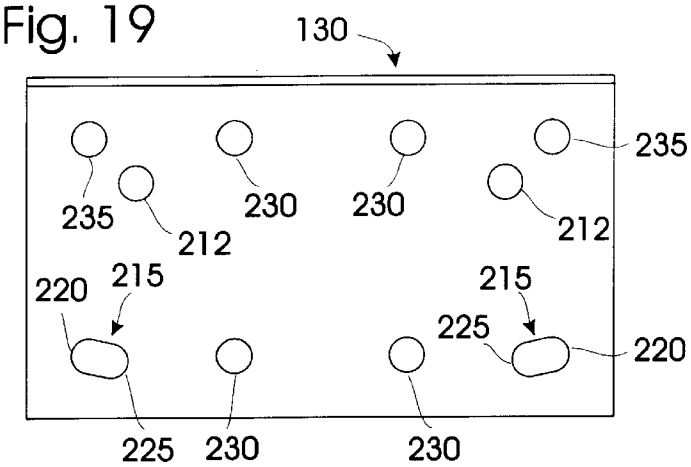
FIG. 19 is a rear elevational view of the cave connector employed by my modular building system.
Figure 21:
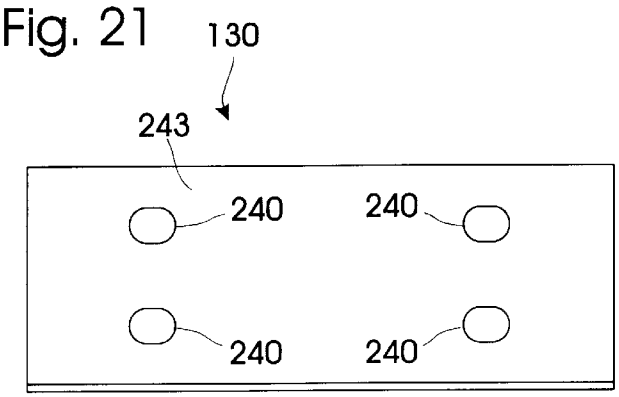
FIG. 21 is a bottom plan view of the eave connector.
Figure 24:
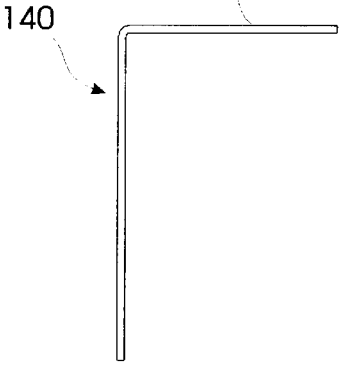
FIG. 24 is an end elevational view of the peak and column connector.
Figure 26:
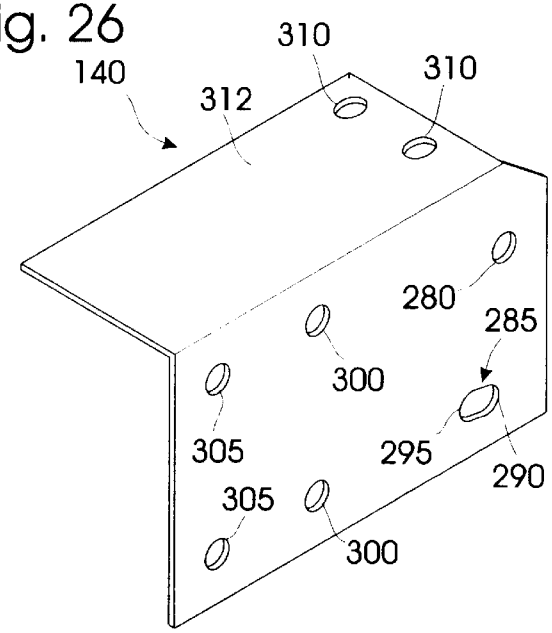
FIG. 26 is an isometric view of the peak and column connector
Figure 23:
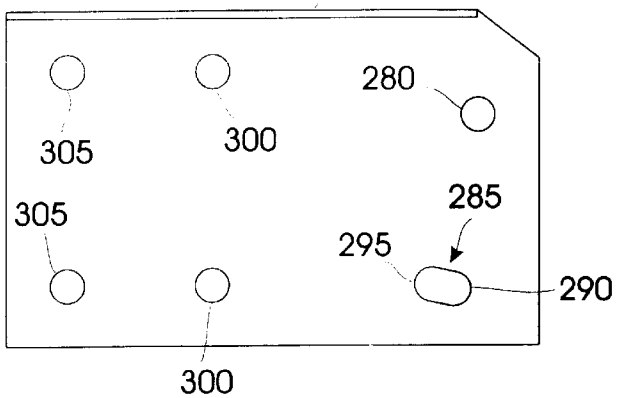
FIG. 23 is a rear elevational view of the peak and column connector employed by my modular building system.
Figure 25:
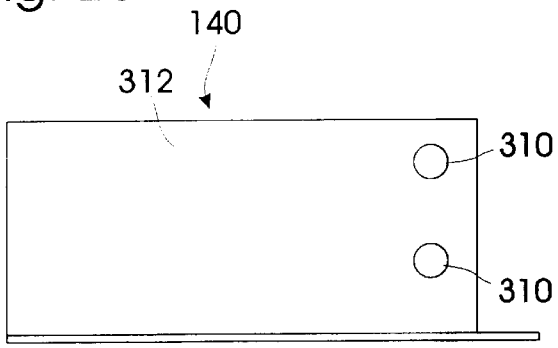
FIG. 25 is a bottom plan view of the peak and column connector.
Figure 28:
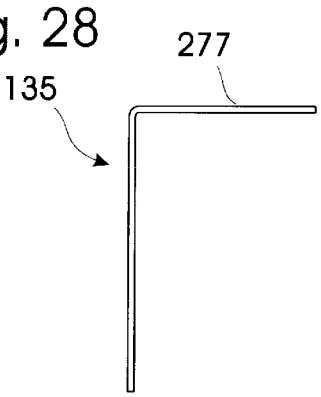
FIG. 28 is an end elevational view of the rafter and column connector.
Figure 30:
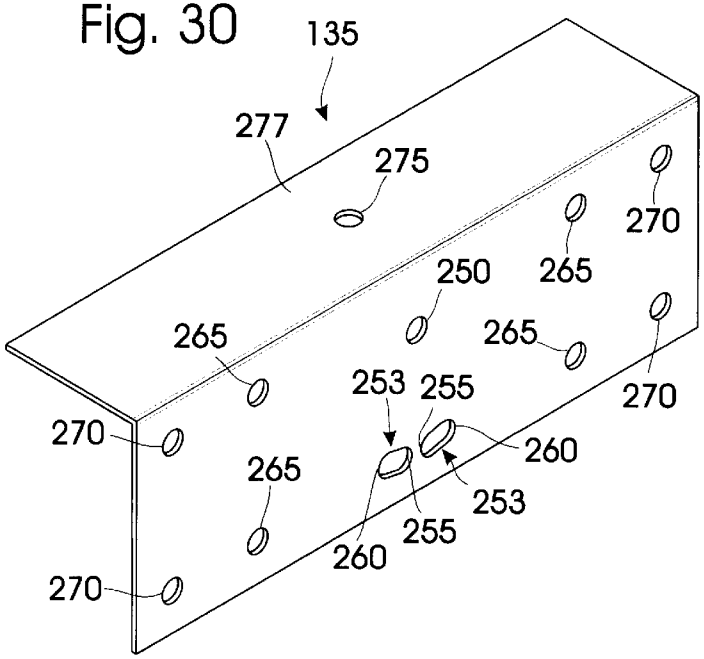
FIG. 30 is an isometric view of the rafter and column connector
Figure 27:
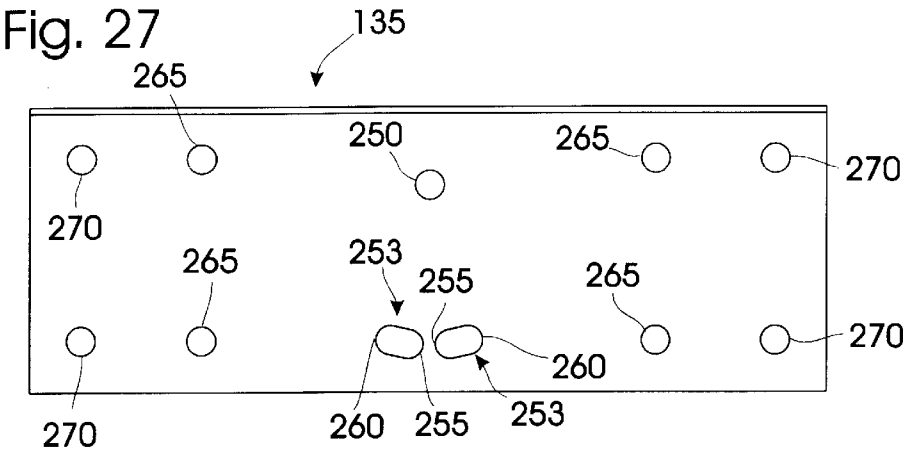
FIG. 27 is a rear elevational view of the rafter and column connector employed by my modular building system.
Figure 29:
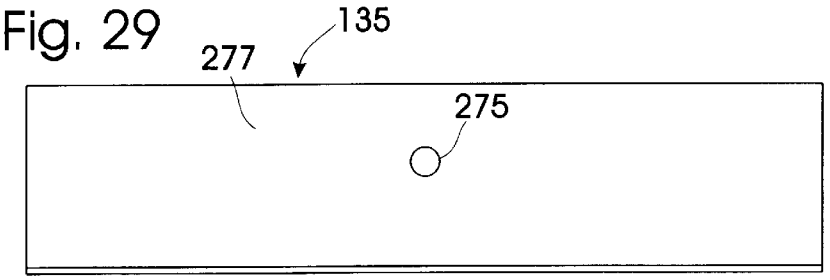
FIG. 29 is a bottom plan view of the rafter and column connector.
Figure 31:
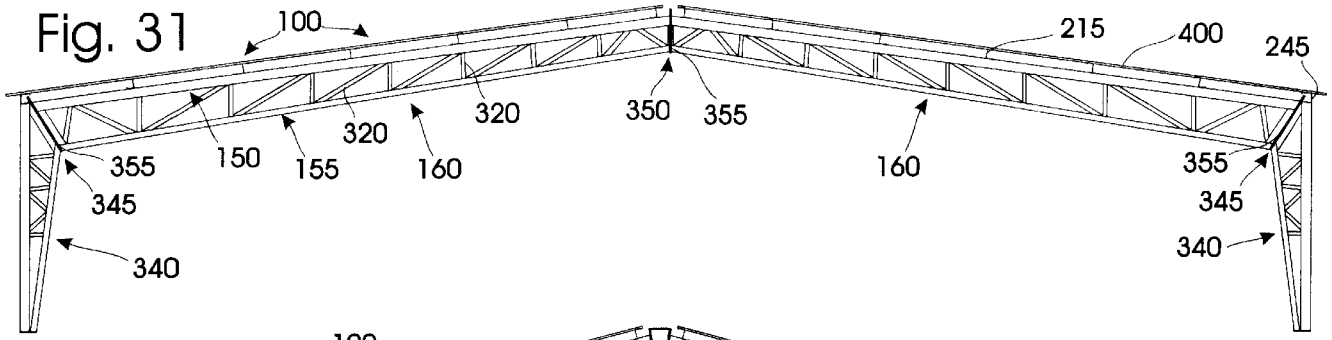
FIG. 31 is a front elevational view of a double pitch, open bay, shallow pitched roof three bay width building frame constructed using my light weight pre-engineered prefabricated modular building system employing a truss.

Separate fixed pitch rafters, a steep pitch rafter 120 or a shallow pitch rafter 125. are employed by a steep pitch building and by a shallow pitch building, respectively. FIGS. 18 and 18A. The free ends of the double pitch rafters 120 or 125 are connected to a rafter 115 and/or a column 110 by a rafter connector 135; or to an eave column 110 by an eave connector 130 utilizing bolt holes 315 defined in the free ends of the rafter 120or 125. Eave and rafter connectors 130 and 135 the open end of a double pitch rafter 120 or 125.

Application of combinations of the basic components of my lightweight pre-engineered prefabricated modular building system 100 are detailed in the tables below for a four inch system. These configurations may be utilized as repeated main frames for column buildings or end wall main frames for open span truss buildings. The first table details the materials used in gable wall frames for single pitch, shallow pitch angle buildings of various heights and widths in the four inch system.

SINGLE PITCH BUILDINGS IN SHALLOW PITCH (2:15)

| Width | Back Height | Front Height | Number of Eave Connectors | Number of Rafter Connectors | Number of Peak Connectors | Number of Straight Rafters | Number and Length of Columns |
|---|---|---|---|---|---|---|---|
| 15' | 8' | 10' | 1 | 0 | 1 | 1 | 1-8' 1-10' |
| 15' | 10' | 12' | 1 | 0 | 1 | 1 | 1-10' 1-12' |
| 15' | 12' | 14' | 1 | 0 | 1 | 1 | 1-12' 1-14' |
| 15' | 14' | 16' | 1 | 0 | 1 | 1 | 1-14' 1-16' |
| 15' | 16' | 18' | 1 | 0 | 1 | 1 | 1-16' 1-18' |
| 30' | 8' | 12' | 1 | 1 | 1 | 2 | 1-8' 1-10' 1-12' |
| 30' | 10' | 14' | 1 | 1 | 1 | 2 | 1-10' 1-12' 1-14' |
| 30' | 12' | 16' | 1 | 1 | 1 | 2 | 1-12' 1-14' 1-16' |
| 30' | 14' | 18' | 1 | 1 | 1 | 2 | 1-14' 1-16' 1-18' |
| 45' | 8' | 14' | 1 | 2 | 1 | 3 | 1-8' 1-10' 1-12' 1-14' |
| 45' | 10' | 16' | 1 | 2 | 1 | 3 | 1-10' 1-12' 1-14' 1-16' |
| 45' | 12' | 18' | 1 | 2 | 1 | 3 | 1-12' 1-14' 1-16' 1-18' |
| 60' | 8' | 16' | 1 | 3 | 1 | 4 | 1-8' 1-10' 1-12' 1-14' 1-16' |
| 60' | 10' | 18' | 1 | 3 | 1 | 4 | 1-10' 1-12' 1-14' 1-16' |
| 75' | 8' | 18' | 1 | 4 | 1 | 5 | 1-8' 1-10' 1-12' 1-14' 1-16' 1-18' |

The table below details the materials used in gable wall frames for single pitch, steep pitch angle buildings of various heights and widths in the four inch system.

SINGLE PITCH BUILDINGS IN STEEP PITCH (4:15)

| Width | Back Height | Front Height | Number of Eave Connectors | Number of Rafter Connectors | Number of Peak Connectors | Number of Straight Rafters | Number and Length of Columns |
|---|---|---|---|---|---|---|---|
| 15' | 8' | 12' | 1 | 0 | 1 | 1 | 1-8' 1-12' |
| 15' | 10' | 14' | 1 | 0 | 1 | 1 | 1-10' 1-14' |
| 15' | 12' | 16' | 1 | 0 | 1 | 1 | 1-12' 1-16' |
| 15' | 14' | 18' | 1 | 0 | 1 | 1 | 1-14' 1-18' |
| 30' | 8' | 16' | 1 | 1 | 1 | 2 | 1-8' 1-14' 1-16' |
| 30' | 10' | 18' | 1 | 1 | 1 | 2 | 1-10' 1-14' 1-18' |

The table below details the materials used in gable wall frames for double pitch, shallow pitch angle buildings of various heights and widths in the four inch system.

DOUBLE PITCH BUILDINGS IN SHALLOW PITCH (2:15)

| Width | Eave Height | Peak Height | Number of Eave Connectors | Number of Rafter Connectors | Number of Peak Connectors | Number of Straight Rafters | Number of Shallow Double Pitch Rafters | Number and Length of Columns |
|---|---|---|---|---|---|---|---|---|
| 15' | 8' | 9' | 2 | 0 | 0 | 0 | 1 | 2-8' |
| 15' | 10' | 11' | 2 | 0 | 0 | 0 | 1 | 2-10' |
| 15' | 12' | 13' | 2 | 0 | 0 | 0 | 1 | 2-12' |
| 15' | 14' | 15' | 2 | 0 | 0 | 0 | 1 | 2-14' |
| 15' | 16' | 17' | 2 | 0 | 0 | 0 | 1 | 2-16' |
| 15' | 18' | 19' | 2 | 0 | 0 | 0 | 1 | 2-18' |
| 30' | 8' | 10' | 2 | 0 | 2 | 2 | 0 | 2-8' 1-10' |
| 30' | 10' | 12' | 2 | 0 | 2 | 2 | 0 | 2-10' 1-12' |
| 30' | 12' | 14' | 2 | 0 | 2 | 2 | 0 | 2-10' 1-14' |
| 30' | 14' | 16' | 2 | 0 | 2 | 2 | 0 | 2-12' 1-16' |
| 30' | 16' | 18' | 2 | 0 | 2 | 2 | 0 | 2-14' 1-18' |
| 45' | 8' | 11' | 2 | 2 | 0 | 2 | 1 | 2-8' 2-10' |
| 45' | 10' | 13' | 2 | 2 | 0 | 2 | 1 | 2-10' 2-12' |
| 45' | 12' | 14' | 2 | 2 | 0 | 2 | 1 | 2-12' 2-14' |
| 45' | 14' | 17' | 2 | 2 | 0 | 2 | 1 | 2-14' 2-16' |
| 45 | 16' | 19' | 2 | 2 | 0 | 2 | 1 | 2-14' 2-18' |
| 60' | 8' | 12' | 2 | 2 | 2 | 4 | 0 | 2-8' 2-10' 1-12' |
| 60' | 10' | 14' | 2 | 2 | 2 | 4 | 0 | 2-10' 2-12' 1-14' |
| 60' | 12' | 16' | 2 | 2 | 2 | 4 | 0 | 2-12' 2-14' 1-16' |
| 60' | 14' | 18' | 2 | 2 | 2 | 4 | 0 | 2-14' 2-16' 1-18' |
| 75' | 8' | 13' | 2 | 4 | 0 | 4 | 1 | 2-8' 2-10' 2-12' |
| 75' | 10' | 15' | 2 | 4 | 0 | 4 | 1 | 2-10' 2-12' 2-14' |
| 75' | 12' | 17' | 2 | 4 | 0 | 4 | 1 | 2-12' 2-14' 2-16' |
| 75' | 14' | 19' | 2 | 4 | 0 | 4 | 1 | 2-14' 2-16' 2-18' |
| 90' | 8' | 14' | 2 | 4 | 2 | 6 | 0 | 2-8' 2-10' 2-12' 1-14' |
| 90' | 10' | 16' | 2 | 4 | 2 | 6 | 0 | 2-10' 2-12' 2-14' 1-16' |
| 90' | 12' | 18' | 2 | 4 | 2 | 6 | 0 | 2-12' 2-14' 2-16' 1-18' |
| 105' | 8' | 15' | 2 | 6 | 0 | 65 | 1 | 2-8' 2-10' 2-12' 2-14' |
| 105' | 10' | 17' | 2 | 6 | 0 | 6 | 1 | 2-10' 2-12' 2-14' 2-16' |
| 105' | 12' | 19' | 2 | 6 | 0 | 6 | 1 | 2-12' 2-14' 2-16' 2-18' |
| 120' | 8' | 16' | 2 | 6 | 2 | 8 | 0 | 2-8' 2-10' 2-12' 2-14' 1-16' |
| 120' | 10' | 18' | 2 | 6 | 2 | 8 | 0 | 2-10' 2-12' 2-14' 2-16' 1-18' |
| 135' | 8' | 17' | 2 | 8 | 0 | 8 | 1 | 2-8' 2-10' 2-12' 2-14' 2-16' |
| 135' | 10' | 19' | 2 | 8 | 0 | 8 | 1 | 2-10' 2-12' 2-14' 2-16' 2-18' |
| 150' | 8' | 18' | 2 | 8 | 2 | 10 | 0 | 2-8' 2-10' 2-12' 2-14' 2-16' 1-18' |
| 165' | 8' | 19' | 2 | 10 | 0 | 10 | 1 | 2-8' 2-10' 2-12' 2-14' 2-16' 2-18' |

The table below details the materials used in gable wall frames for double pitch, steep pitch angle buildings of various heights and widths in the four inch system.

DOUBLE PITCH BUILDINGS IN STEEP PITCH

| Width | Eave Height | Peak Height | Number of Eave Connectors | Number of Rafter Connectors | Number of Peak Connectors | Number of Straight Rafters | Number of Steep Double Pitch Rafters | Number & Length of Columns |
|---|---|---|---|---|---|---|---|---|
| 15' | 8' | 10' | 2 | 0 | 0 | 0 | 1 | 2-8' |
| 15' | 10' | 12' | 2 | 0 | 0 | 0 | 1 | 2-10' |
| 15' | 12' | 14' | 2 | 0 | 0 | 0 | 1 | 2-12' |
| 15' | 14' | 16' | 2 | 0 | 0 | 0 | 1 | 2-14' |
| 15' | 16' | 18' | 2 | 0 | 0 | 0 | 1 | 2-16' |
| 15' | 18' | 20' | 2 | 0 | 0 | 0 | 1 | 2-18' |
| 30' | 8' | 12' | 2 | 0 | 2 | 2 | 0 | 2-8' 1-12' |
| 30' | 10' | 14' | 2 | 0 | 2 | 2 | 0 | 2-10' 1-14' |
| 30' | 12' | 16' | 2 | 0 | 2 | 2 | 0 | 2-12' 1-16' |
| 30' | 14' | 18' | 2 | 0 | 2 | 2 | 0 | 2-14' 1-18' |
| 45' | 8' | 14' | 2 | 2 | 0 | 2 | 1 | 2-8' 2-12' |
| 45' | 10' | 16' | 2 | 2 | 0 | 2 | 1 | 2-10' 2-14' |
| 45' | 12' | 18' | 2 | 2 | 0 | 2 | 1 | 2-12' 2-16' |
| 45' | 14' | 20' | 2 | 2 | 0 | 2 | 1 | 2-14' 2-18' |
| 60' | 8' | 16' | 2 | 2 | 2 | 4 | 0 | 2-8' 2-12' 1-16' |
| 60' | 10' | 18' | 2 | 2 | 2 | 4 | 0 | 2-10' 2-14' 1-18' |
| 75' | 8' | 18' | 2 | 4 | 0 | 4 | 1 | 2-8' 2-12' 2-16' |
| 75' | 10' | 20' | 2 | 4 | 0 | 4 | 1 | 2-10' 2-14' 2-18' |

The table below details the materials used in gable wall frames for cantilevered double pitch buildings, of various widths and height combinations, having a shallow pitch angle in the four inch system. These buildings have one taller side wall and one shorter side wall.

The table below details the materials used in gable wall frames for cantilevered double pitch buildings, of various widths and height combinations, having a steep pitch angle in the four inch system. These buildings have one taller side wall and one shorter side wall.

CANTILEVERED BUILDINGS - SHALLOW PITCH (2:15)

| Width | Back Eave | Front Eave | Peak Height | Number of Eave Connectors | Number of Rafter Connectors | Number of Peak Connectors | Number of Straight Rafters | Number of Double Rafters | Number and Length of Columns |
|---|---|---|---|---|---|---|---|---|---|
| 30' | 8' | 10' | 11' | 2 | 1 | 0 | 1 | 1 | 1-8' 2-10' |
| 30' | 10' | 12' | 13' | 2 | 1 | 0 | 1 | 1 | 1-10' 2-12' |
| 30' | 12' | 14' | 15' | 2 | 1 | 0 | 1 | 1 | 1-12' 2-14' |
| 30' | 14' | 16' | 17' | 2 | 1 | 0 | 1 | 1 | 1-14' 2-16' |
| 30' | 16' | 18' | 19' | 2 | 1 | 0 | 1 | 1 | 1-16' 2-18' |
| 45' | 8' | 12' | 13' | 2 | 2 | 0 | 2 | 1 | 1-8' 1-10' 2-12' |
| 45' | 10' | 14' | 15' | 2 | 2 | 0 | 2 | 1 | 1-10' 1-12' 2-14' |
| 45' | 12' | 16' | 17' | 2 | 2 | 0 | 2 | 1 | 1-12' 1-14' 2-16' |
| 45' | 14' | 18' | 19' | 2 | 2 | 0 | 2 | 1 | 1-14' 1-16' 2-18' |
| 45' | 8' | 10' | 12' | 2 | 1 | 2 | 3 | 0 | 1-8' 2-10' 1-12' |
| 45' | 10' | 12' | 14' | 2 | 1 | 2 | 3 | 0 | 1-10' 2-12' 1-12' |
| 45' | 12' | 14' | 16' | 2 | 1 | 2 | 3 | 0 | 1-12' 2-14' 1-16' |
| 45' | 14' | 16' | 16' | 2 | 1 | 2 | 3 | 0 | 1-14' 2-16' 1-18' |
| 60' | 8' | 14' | 15' | 2 | 3 | 0 | 3 | 1 | 1-8' 1-10' 1-12' 2-14' |
| 60' | 10' | 16' | 17' | 2 | 3 | 0 | 3 | 1 | 1-10' 1-12' 1-14' 2-16' |
| 60' | 12' | 18' | 19' | 2 | 3 | 0 | 3 | 1 | 1-12' 1-14' 1-16' 2-18' |
| 60' | 8' | 10' | 13' | 2 | 3 | 0 | 3 | 1 | 1-8' 2-10' 2-12' |
| 60' | 10' | 12' | 15' | 2 | 3 | 0 | 3 | 1 | 1-10' 2-12' 2-14' |
| 60' | 12' | 14' | 17' | 2 | 3 | 0 | 3 | 1 | 1-12' 2-14' 2-16' |
| 60' | 14' | 16' | 19' | 2 | 3 | 0 | 3 | 1 | 1-14' 2-16' 2-18' |
| 60' | 8' | 12' | 14' | 2 | 2 | 2 | 4 | 0 | 1-8' 1-10' 2-12' 1-14' |
| 60' | 10' | 14' | 16' | 2 | 2 | 2 | 4 | 0 | 1-10' 1-12' 2-14' 1-16' |
| 60' | 12' | 16' | 18' | 2 | 2 | 2 | 4 | 0 | 1-12' 1-14' 2-16' 1-18' |
| 75' | 8' | 16' | 17' | 2 | 4 | 0 | 4 | 1 | 1-8' 1-10' 1-12' 1-14' 2-16' |
| 75' | 10' | 18' | 19' | 2 | 4 | 0 | 4 | 1 | 1-10' 1-12' 1-14' 1-16' 2-18' |
| 75' | 8' | 10' | 14' | 2 | 3 | 2 | 5 | 0 | 1-8' 2-10' 2-12' 1-14' |
| 75' | 10' | 12' | 16' | 2 | 3 | 2 | 5 | 0 | 1-10' 2-12' 2-14' 2-16' |
| 75' | 12' | 14' | 18' | 2 | 3 | 2 | 5 | 0 | 1-12' 2-14' 2-16' 1-18' |
| 75' | 8' | 14' | 16' | 2 | 3 | 2 | 5 | 0 | 1-8' 1-10' 1-12' 2-14' 1-16' |
| 75' | 10' | 16' | 18' | 2 | 3 | 2 | 5 | 0 | 1-10' 1-12' 1-14' 2-16' 1-18' |
| 75' | 8' | 12' | 15' | 2 | 4 | 0 | 4 | 1 | 1-8' 1-10' 2-12' 2-14' |
| 75' | 10' | 14' | 17' | 2 | 4 | 0 | 4 | 1 | 1-10' 1-12' 2-14' 2-16' |
| 75' | 12' | 16' | 19' | 2 | 4 | 0 | 4 | 1 | 1-12' 1-14' 2-16' 2-18' |
| 90' | 8' | 18' | 19' | 2 | 5 | 0 | 5 | 1 | 1-8' 1-10' 1-12' 1-14' 1-16' 2-18' |
| 90' | 8' | 12' | 16' | 2 | 4 | 2 | 6 | 0 | 1-8' 1-10' 2-12' 2-14' 1-16' |
| 90' | 10' | 14' | 18' | 2 | 4 | 2 | 6 | 0 | 1-10' 1-12' 2-14' 2-16' 1-18' |
| 90' | 8' | 16' | 18' | 2 | 4 | 2 | 6 | 0 | 1-8' 1-10' 1-12' 1-14' 2-16' 1-18' |
| 90' | 8' | 14' | 17' | 2 | 5 | 0 | 5 | 1 | 1-8' 1-10' 1-12' 2-14' 2-16' |
| 90' | 10' | 16' | 19' | 2 | 5 | 0 | 5 | 1 | 1-10' 1-12' 1-14' 2-16' 2-18' |
| 90' | 8' | 10' | 15' | 2 | 5 | 0 | 5 | 1 | 1-8' 2-10' 2-12' 2-14' |
| 90' | 10' | 12' | 17' | 2 | 5 | 0 | 5 | 1 | 1-10' 2-12' 2-14' 2-16' |
| 90' | 12' | 14' | 19' | 2 | 5 | 0 | 5 | 1 | 1-12' 2-14' 2-16' 2-18' |
| 105' | 8' | 16' | 19' | 2 | 6 | 0 | 6 | 1 | 1-8' 1-10' 1-12' 1-14' 2-16' 2-18' |
| 105' | 8' | 10' | 16' | 2 | 5 | 2 | 7 | 0 | 1-8' 2-10' 2-12' 2-14' 1-16' |
| 105' | 10' | 12' | 18' | 2 | 5 | 2 | 7 | 0 | 1-10' 2-12' 2-14' 2-16' 1-18' |
| 105' | 8' | 14' | 18' | 2 | 5 | 2 | 7 | 0 | 1-8' 1-10' 1-12' 2-14' 2-16' 1-18' |
| 105' | 8' | 12' | 17' | 2 | 6 | 0 | 6 | 1 | 1-8' 1-10' 2-12' 2-14' 2-16' |
| 105' | 10' | 12' | 19' | 2 | 6 | 0 | 6 | 1 | 1-10' 1-12' 2-14' 2-16' 2-18' |
| 120' | 8' | 14' | 19' | 2 | 7 | 0 | 7 | 1 | 1-8' 1-10' 1-12' 2-14' 2-16' 2-18' |
| 120' | 8' | 10' | 17' | 2 | 7 | 0 | 7 | 1 | 1-8' 2-10' 2-12' 2-14' 2-16' |
| 120' | 10' | 12' | 19' | 2 | 7 | 0 | 7 | 1 | 1-10' 2-12' 2-14' 2-16' 2-18' |
| 120' | 8' | 12' | 18' | 2 | 6 | 2 | 8 | 0 | 1-8' 1-10' 2-12' 2-14' 2-16' 1-18' |
| 135' | 8' | 12' | 19' | 2 | 8 | 0 | 8 | 1 | 1-8' 1-10' 2-12' 2-14' 2-16' 2-18' |
| 135' | 8' | 10' | 18' | 2 | 7 | 2 | 9 | 0 | 1-8' 2-10' 2-12' 2-14' 2-16' 1-18' |
| 150' | 8' | 10' | 19' | 2 | 9 | 0 | 9 | 1 | 1-8' 2-10' 2-12' 2-14' 2-16' 2-18' |

CANTILEVERS STEEP PITCH 4:15

| Width | Back Eave | Front Eave | Peak Height | Number of Eave Connectors | Number of Rafter Connectors | Number of Peak Connectors | Number of Straight Rafters | Number of Steep Double Pitch Rafters | Number and Length of Columns |
|---|---|---|---|---|---|---|---|---|---|
| 30' | 8' | 12' | 14' | 2 | 1 | 0 | 1 | 1 | 1-8' 2-12' |
| 30' | 10' | 14' | 16' | 2 | 1 | 0 | 1 | 1 | 1-10' 2-14' |
| 30' | 12' | 16' | 18' | 2 | 1 | 0 | 1 | 1 | 1-12' 2-16' |
| 30' | 14' | 18' | 20' | 2 | 1 | 0 | 1 | 1 | 1-14' 2-18' |
| 45' | 8' | 16' | 18' | 2 | 2 | 0 | 2 | 1 | 1-8' 1-12' 2-16' |
| 45' | 10' | 18' | 20' | 2 | 2 | 0 | 2 | 1 | 1-10' 1-14' 2-18' |
| 45' | 8' | 12' | 16' | 2 | 1 | 1 | 3 | 0 | 1-8' 2-12' 1-16' |
| 45' | 10' | 14' | 18' | 2 | 1 | 1 | 3 | 0 | 1-10' 2-14' 1-18' |
| 60' | 8' | 12' | 18' | 2 | 3 | 0 | 3 | 1 | 1-8' 2-12' 2-16' |
| 60' | 10' | 14' | 20' | 2 | 3 | 0 | 3 | 1 | 1-10' 2-14' 2-18' |

The table below details the materials used in gable wall frames for buildings, of various widths and height combinations, having two different pitch angles in the four inch system. These buildings have one taller side wall and one shorter side wall.

COMBINATION PITCH BUILDINGS

| Width | Back Eave | Front Eave | Peak Height | Number of Eave Connectors | Number of Rafter Connectors | Number of Peak Connectors | Number of Straight Rafters | Number of Double Pitch Rafters | Number and Length of Columns |
|---|---|---|---|---|---|---|---|---|---|
| 30' | 8' | 10' | 12' | 2 | 0 | 2 | 2 | 0 | 1-8' 1-12' 1-10' |
| 30' | 10' | 12' | 14' | 2 | 0 | 2 | 2 | 0 | 1-10' 1-14' 1-12' |
| 30' | 12' | 14' | 16' | 2 | 0 | 2 | 2 | 0 | 1-12' 1-16' 1-14' |
| 30' | 14' | 16' | 18' | 2 | 0 | 2 | 2 | 0 | 1-14' 1-18' 1-16' |
| 45' | 8' | 8' | 12' | 2 | 1 | 2 | 3 | 0 | 2-8' 1-10' 1-12' |
| 45' | 10' | 10' | 14' | 2 | 1 | 2 | 3 | 0 | 2-10' 1-12' 1-14' |
| 45' | 12' | 12' | 16' | 2 | 1 | 2 | 3 | 0 | 2-12' 1-14' 1-16' |
| 45' | 14' | 14' | 18' | 2 | 1 | 2 | 3 | 0 | 2-14' 1-16' 1-18' |
| 60' | 8' | 12' | 16' | 2 | 2 | 2 | 4 | 0 | 1-8' 2-12' 1-16' 1-14' |
| 60' | 10' | 14' | 18' | 2 | 2 | 2 | 4 | 0 | 1-10' 2-14' 1-18' 1-16' |
| 60' | 8' | 10' | 14' | 2 | 2 | 2 | 4 | 0 | 1-8' 2-10' 1-12' 1-14' |
| 60' | 10' | 12' | 16' | 2 | 2 | 2 | 4 | 0 | 1-10' 2-12' 1-14' 1-16' |
| 60' | 12' | 14' | 18' | 2 | 2 | 2 | 4 | 0 | 1-12' 2-14' 1-16' 1-18' |
| 75' | 8' | 12' | 16' | 2 | 3 | 2 | 5 | 0 | 1-8' 1-10' 2-12' 1-14' 1-16' |
| 75' | 10' | 14' | 18' | 2 | 3 | 2 | 5 | 0 | 1-10' 1-12' 2-14' 1-16' 1-18' |
| 75' | 10' | 8' | 16' | 2 | 3 | 2 | 5 | 0 | 1-10' 2-12' 1-14' 1-16' 1-8' |
| 75' | 12' | 10' | 18' | 2 | 3 | 2 | 5 | 0 | 1-12' 2-14' 1-16' 1-18' 1-10' |
| 90' | 8' | 14' | 18' | 2 | 4 | 2 | 6 | 0 | 1-8' 1-10' 1-12' 2-14' 1-16' 1-18' |
| 90' | 8' | 8' | 16' | 2 | 4 | 2 | 6 | 0 | 2-8' 1-10' 2-12' 1-14' 1-16' |
| 90' | 10' | 10' | 18' | 2 | 4 | 2 | 6 | 0 | 2-10' 1-12' 2-14' 1-16' 1-18' |

Figure 33:
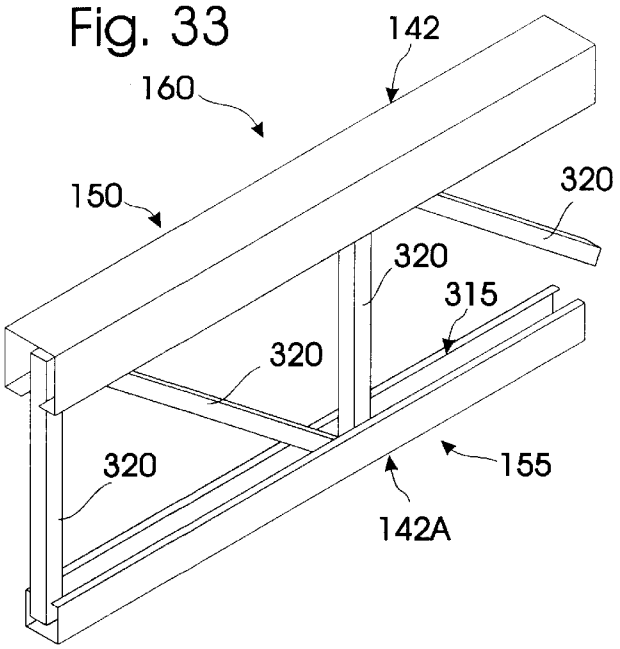
FIG. 33 is a fragmentary isometric view of a truss employing two sizes of principal structural members and tubular web members.

The principal structural members 142 are also employed as components in trusses 160. Two sizes of the principal structural member 142 are employed. FIG. 33. The top cord 150 of the truss 160 is a larger member 142, generally the same size as columns 110. The bottom cord 155 of the truss 160 is a smaller member 142A. In the illustrated embodimen members 142 and 142A, forming the cords 150 and 155, receive square tubular web members 320. Both size members 142 and 142A have the same size notch 145. The tubular web members 320 are welded in place on both sides of the notch 145. Spacing and thickness of the web members 320 is dependent upon load requirements.

Figure 14:
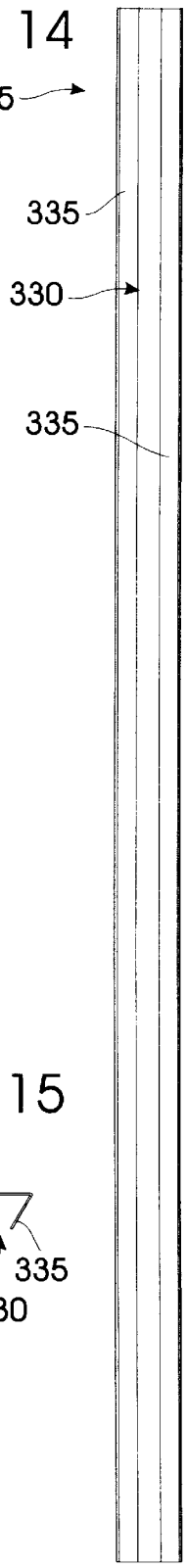
FIG. 14 is a front elevational view of an alternative angular structural member which can be employed in the trusses in my modular building system.
Figure 15:
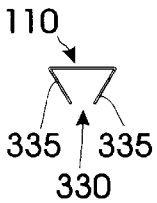
FIG. 15 is a top plan view of an alternative angular structural member.
Figure 34:
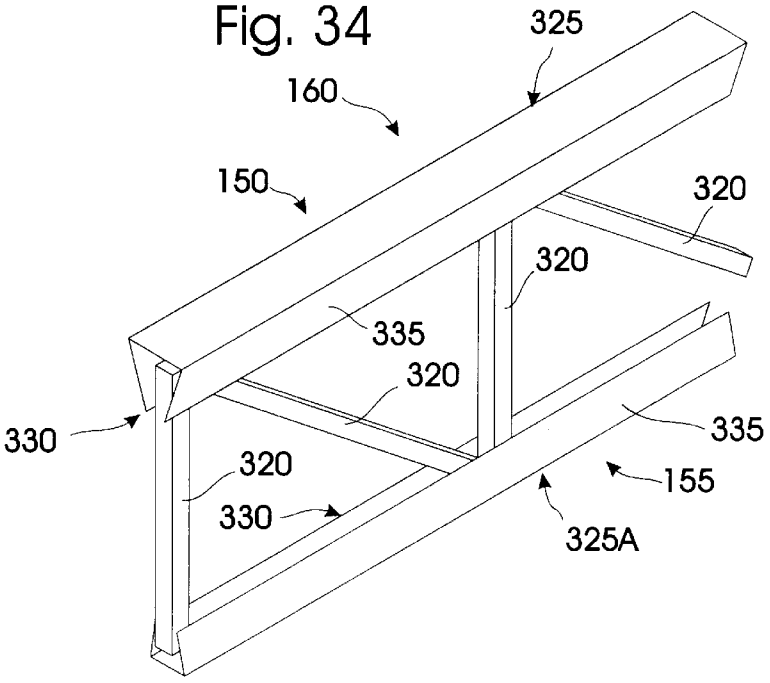
FIG. 34 is a fragmentary isometric view of a truss employing two sizes of alternative angular truss members and tubular web members.

Alternatively, an angular structural member 325 is employed to create trusses 160. FIG. 34. The angular structural member 325 is a three sided elongated member 325 having a generally truncated triangular cross-section. FIGS. 14 and 15. The opening 330 defined by the two legs 335 of the angular structural member receives tubular truss web members 320. Two size angular structural members 325 and 325A are utilized in trusses 160. The larger size angular structural members 325 is used as the top cord 150 of the truss 160 and the smaller size angular structural members 325A is used as the bottom cord 155. Both size angular structural members 325 and 325A have the same width openings 330.

Figure 32:
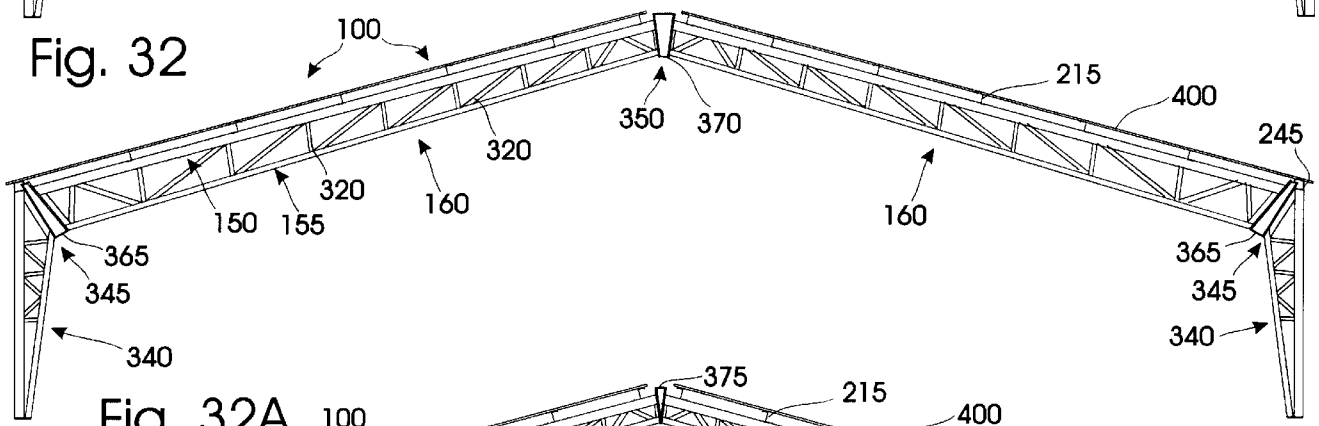
FIG. 32 is a front elevational view of a double pitch, open bay, steep pitched roof three bay width building frame constructed using my light weight pre-engineered prefabricated modular building system employing a truss with steep pitch truss peak and eave spacer plates.
Figure 32A:
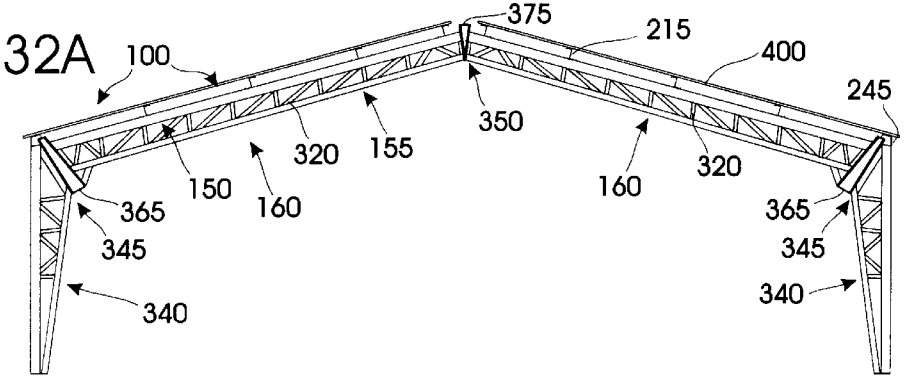
FIG. 32A is a front elevational view of a double pitch, open bay. steep pitched roof two bay width building frame constructed using my light weight pre-engineered prefabricated modular building system employing a truss with steep pitch truss peak and eave spacer plates.
Figure 36:
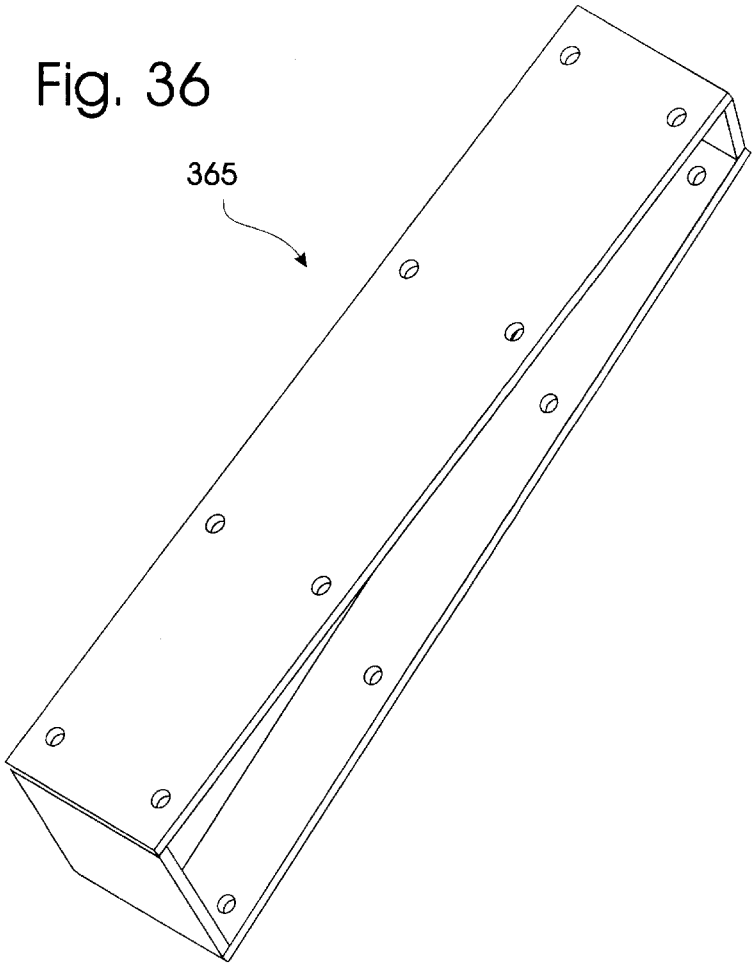
FIG. 36 is an isometric view of a steep pitch eave truss spacer plate.
Figure 35:
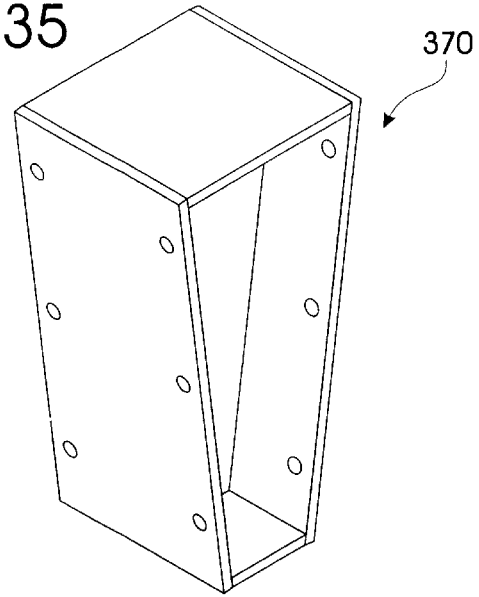
FIG. 35 is an isometric view of a steep pitch peak truss spacer plate used in three bay building frames.
Figure 35A:
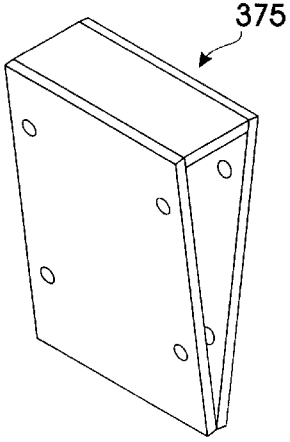
FIG. 35A is an isometric view of a steep pitch peak truss spacer plate used in two bay building frames.

The system's modular trusses 160 and truss legs 340 are interchangeable in height and width, as well as pitch. The ends of the trusses 160 and 340 are joined at the haunch 345 and peak 350 by end and top plates 355. Truss pitch spacer plates 365, 370 and 375 allow the same trusses 160 and truss legs 340 to be used in steep pitch roof buildings. FIGS. 32 and 32A. A truss peak spacer plate 370 or 375 (FIGS. 35 and 35A) is used at the peak 350 to join trusses 160, and a truss eave spacer plate 365 (FIG. 36) is used to join trusses 160 to truss legs 340 in a steep pitch building. This allows a dealer or distributor to stock multiple width buildings in shallow and steep pitches, in different heights by stocking trusses 160. truss legs 340 and three pitch spacer plates 365, 370 and 375.

Figure 37:
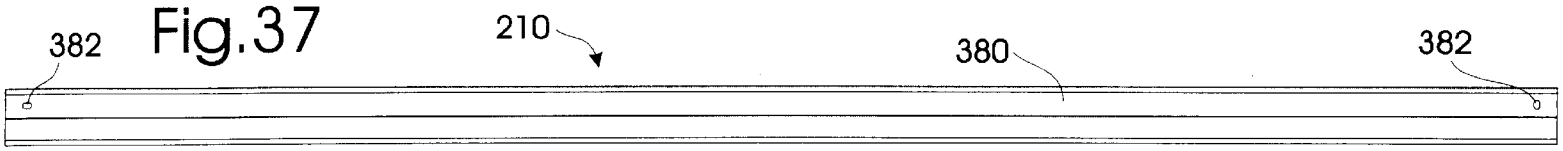
FIG. 37 is a top plan view of a purlin employed in the modular building system.
Figure 39:
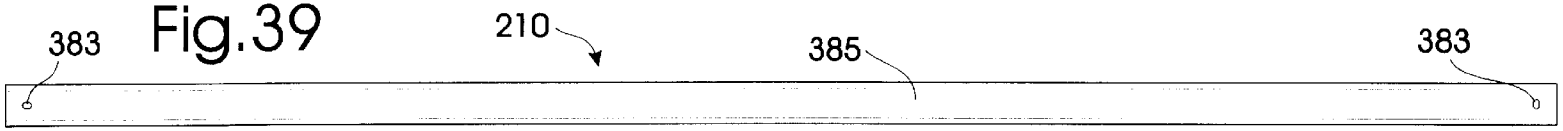
FIG. 39 is a side elevational view of a purlin.
Figure 38:
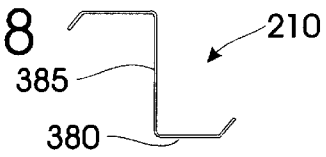
FIG. 38 is a greatly enlarged end view of a purlin.

The purlins 210 employed in the present system 100 have a generally "Z" shaped cross-section. FIGS. 37 through 39.

Thickness of the purlin members 215 (FIG. 38) is determined by regional conditions and length of members. The lower horizontal leg 380 of the purlins 210 define elongated slots 382 for attachment to rafters 115, 120 and 125 and trusses 160. Purlins 210 may be bolted directly to predrilled or punched rafter 115, 120 or 125 or purlin clips may be used to attach purlins 210 to rafters 115, 120 or 125 using self drilling screws or welded in place. The purlins 210 define elongated slots 383 on the vertical portion 385 of the member near the ends to adjoin purlins 210. The length of the purlins 210 is dependent on lap configuration. In other words, the overlap of the purlins 210 may be increased to increase roof load capabilities. The holes 383 are punched in the vertical leg 385 of the purlin 210 are appropriately spaced to secure laps. Purlins 210 may be attached in several ways.

Figure 41:
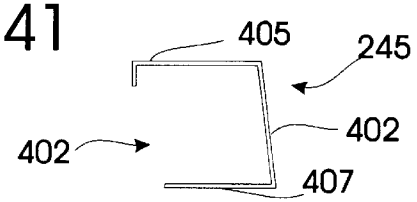
FIG. 41 is a greatly enlarged end view of an eave peak strut.
Figure 40:
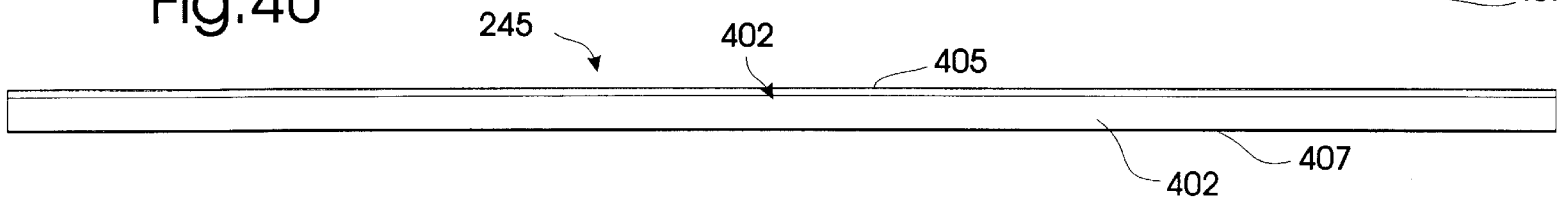
FIG. 40 is an inside elevational view of an eave-peak strut employed in the modular building system.
Figure 42:
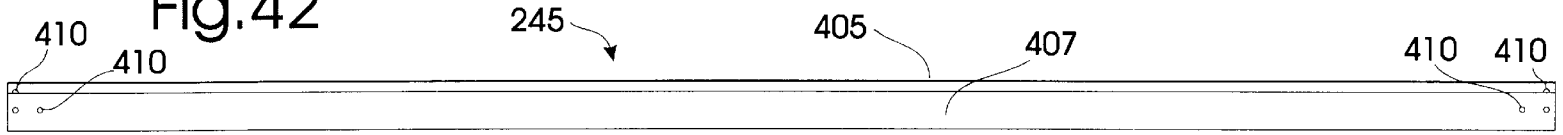
FIG. 42 is a bottom plan view of an eave-peak strut.

An eave-peak strut 245 (FIGS. 40–42) is employed at the eave 390 of the building and at the peak 350 for attachment of exterior sheathing 400 or skin (FIGS. 1–3). The eave-peak strut 245, illustrated in FIGS. 40 through 42, attaches to the eave connector 130 of all building configurations. with the strut's open face 402 facing inward, creating the upper outside portion of the building frame. Side wall skin 400 is attached to the side leg 403 of the eave-peak strut 245 using self tapping drill screws. The upper portion 405 of the eave-peak strut is utilized for attaching exterior roof sheets 400 at the eave 390.

At the building peak 350 on single pitch buildings, the eave-peak strut 245 is inverted and attached to the peak connector 140 with the open face 402 facing inward. The roof sheets 400 are attached to the bottom leg 407 in single pitch buildings. Each end of the eave peak strut 245 is punched with a hole 410 to align it with the top holes 240 and 310 of appropriate connectors 130 and 140.

Figure 43:
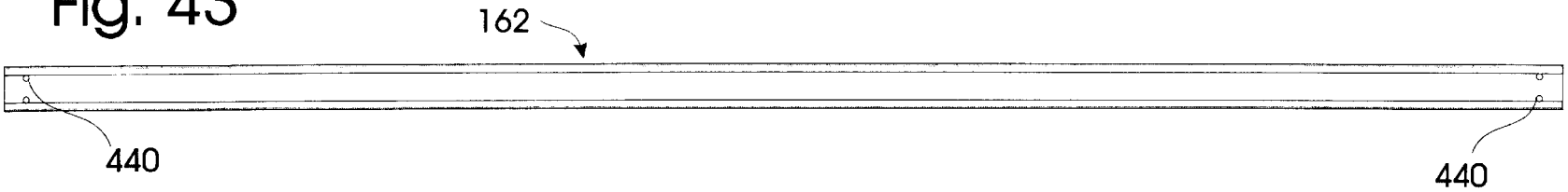
FIG. 43 is an inside elevational view of a girt employed in the modular building system.
Figure 44:
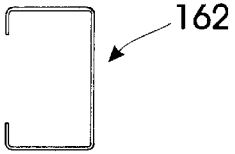
FIG. 44 is a greatly enlarged end view of a girt.

Horizontally disposed girts 162 are utilized for gable wall and side wall skin 400 attachment. See FIGS. 47 through 52 and FIGS. 54 and 55. The girts 162 are generally rectangular, tubular elongated members having a "C" shaped cross-section (FIGS. 43 and 44) and are secured to the exterior wall columns 110 or truss legs 340. The base of the wall skins 400 are attached to either a base angle anchored to the floor of the building or to a base girt 162 spaced above the concrete slab, attached to a column 110 or framed opening with clips. Generally, at least two additional spaced apart girts 162 are utilized in each bay. The girts 162 define holes 440 on each end for securing the girt in place.

In the four inch rhythm there are four bay lengths: twelve feet, fifteen feet, eighteen feet and twenty-one feet. Utilization of these bay lengths create three separate load conditions. The shorter the bay , the greater the roof load capabilities.

The present purlin 210, strut 245, and girt 162 system allows a wide range of building lengths. These modular bay length configurations allow dealers or distributors to stock few components for a vast array of building configurations.

Figure 45:
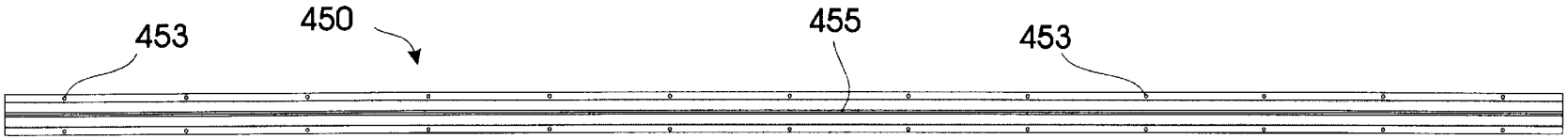
FIG. 45 is a partially fragmented front elevational view of a column stiffener which can be employed in conjunction with a principal structural member in my modular building system.
Figure 46:
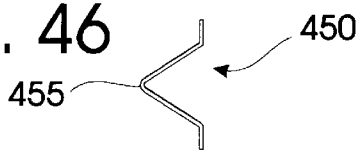
FIG. 46 is a greatly enlarged end view of a column stiffener.
Figure 47:
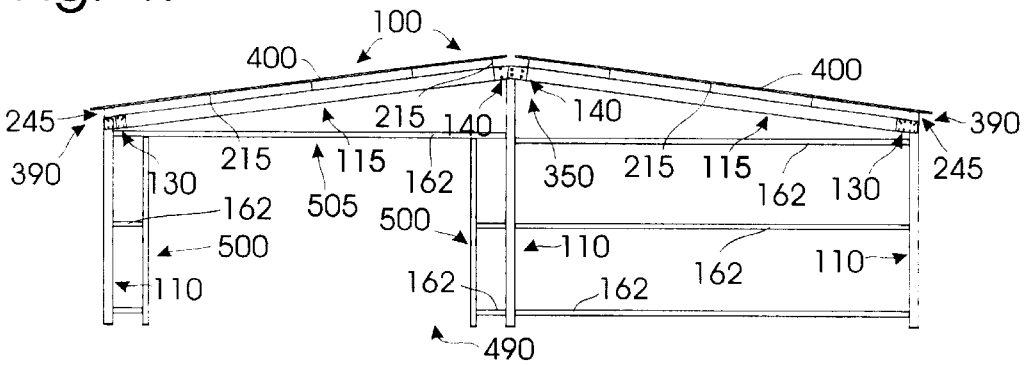
FIG. 47 is a partially fragmented front elevational view of a shallow pitch angle, double pitch building frame constructed using my building system employing a peak connector and center column, illustrating the deployment of girts and door openings.
Figure 48:
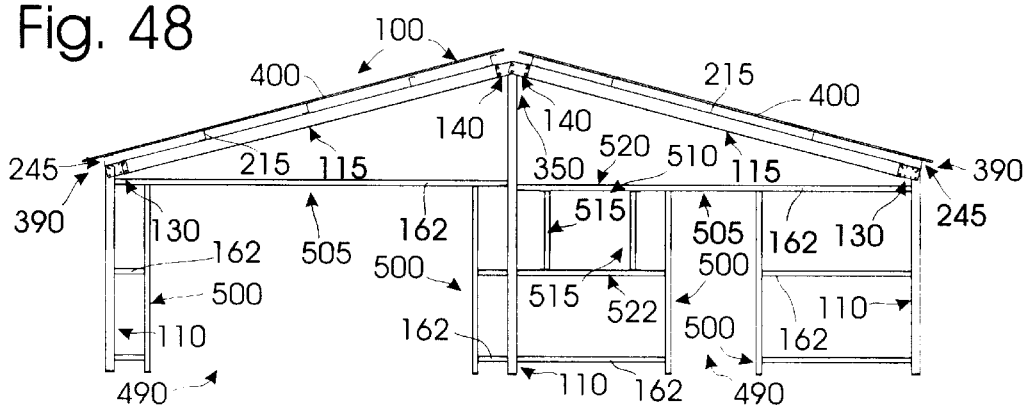
FIG. 48 is a partially fragmented front elevational view of a steep pitch angle, double pitch building frame constructed using my building system employing a peak connector and center column, illustrating the deployment of girts, window openings and door openings.
Figure 49:
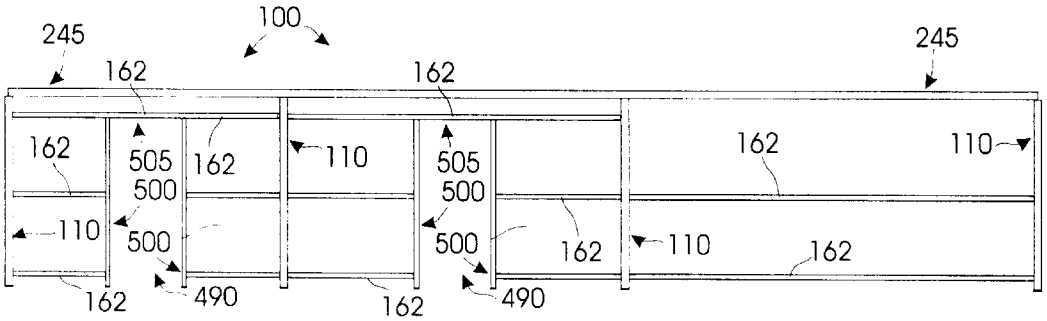
FIG. 49 is a partially fragmented side elevational view of a building frame constructed using my building system, with various bay lengths illustrating the deployment of girts and door openings.
Figure 50:
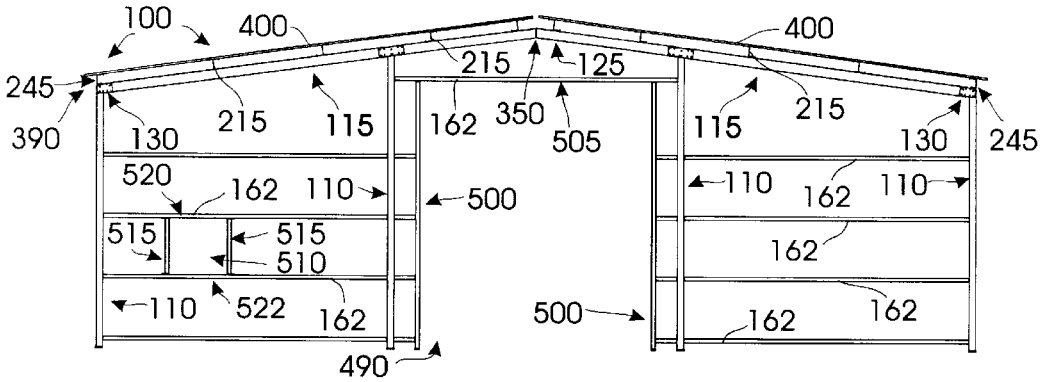
FIG. 50 is a front elevational view of a shallow pitch angle, double pitch building frame constructed using my building system employing a shallow pitch prefabricated double pitch rafter, illustrating the deployment of girts, window openings and door openings.
Figure 51:
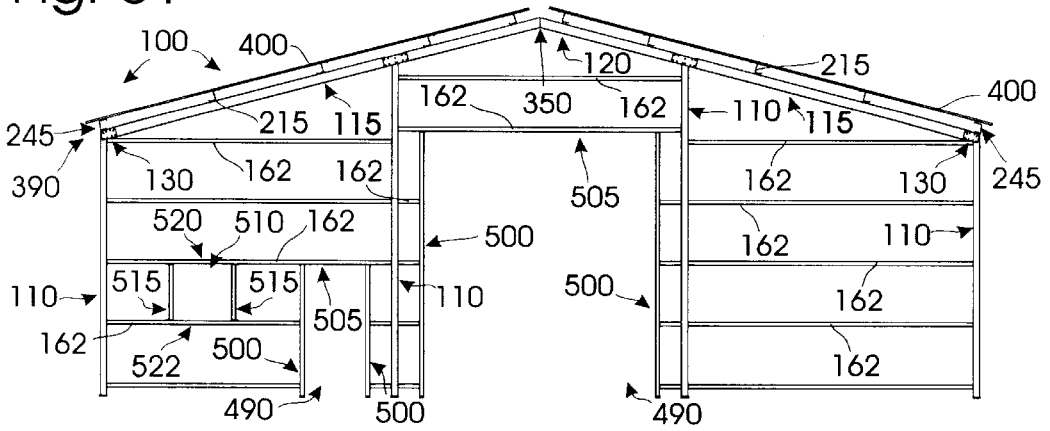
FIG. 51 is a partially fragmented front elevational view of a steep pitch angle, double pitch building frame constructed using my building system employing a steep pitch prefabricated double pitch rafter, illustrating the deployment of girts, window openings and door openings.
Figure 52:
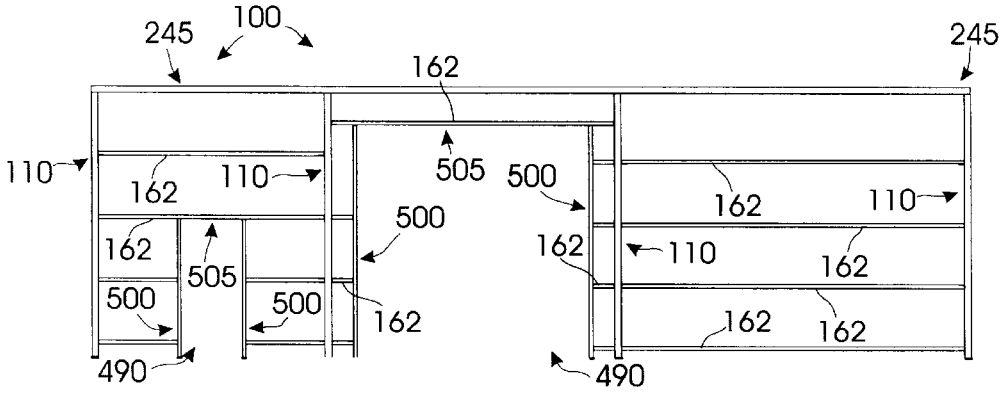
FIG. 52 is a partially fragmented side elevational view of a building frame constructed using my building system, with various bay lengths, illustrating the deployment of girts and door openings.

Alternatively, a column stiffener 450 is used to greatly enhance column 110 load capabilities and bending due to wind loads (FIGS. 45 and 46). This stiffener 450 has a generally "V" shaped cross-section and is attached along the length of a column 110 using self tapping drill screws through the holes 453 with the apex 455 of the stiffener outside the column 110. The resultant triangulated configuration dramatically increases the column's load and bending capabilities. The width and depth of the column stiffener 450 depends on column size and load conditions.

Figure 53:
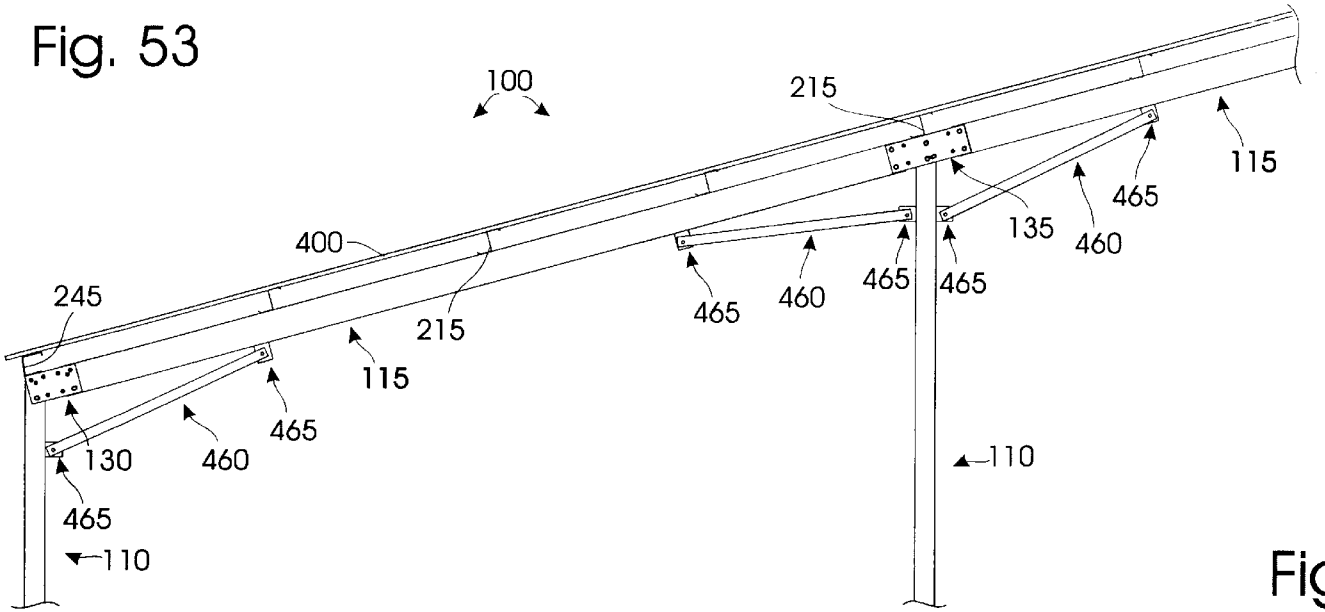
FIG. 53 is a fragmented elevational view of a portion of a building frame constructed using my building system employing kicker braces.
Figure 54:
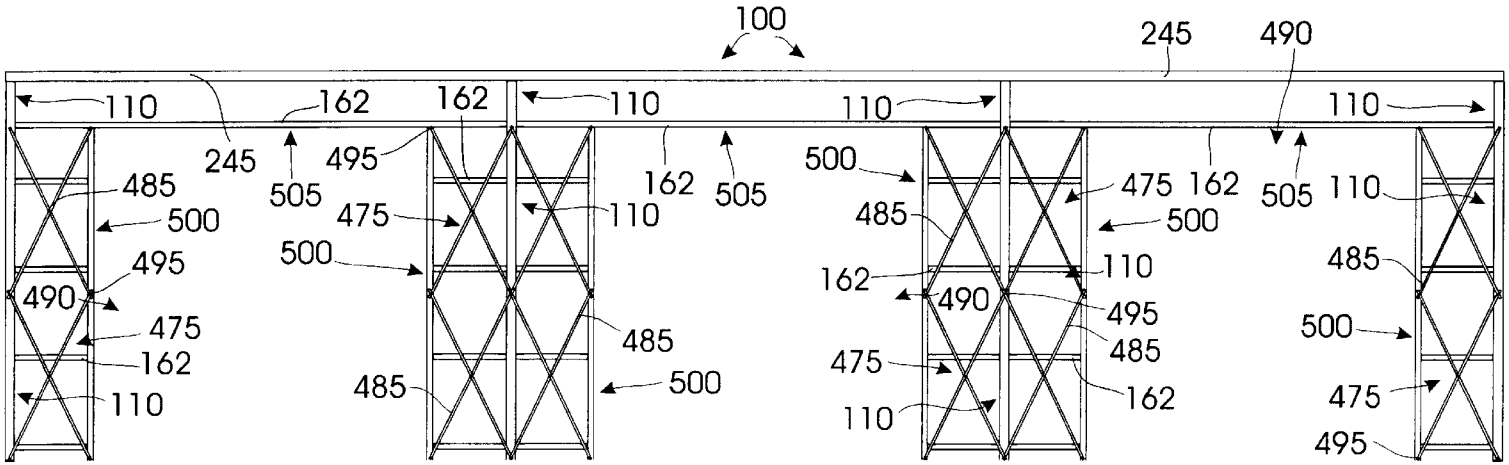
FIG. 54 is a partially fragmented side elevational view of a building frame constructed using my building system, illustrating the use of strap type X-bracing to create a portable frame as well as door openings; and, FIG. 55 is a partially fragmented isometric view of a building frame constructed using my building system employing a prefabricated double pitch rafter, cable type X-bracing and kicker braces; and, FIG. 56 is a partially fragmented front elevational view of a steep pitch angle, double pitch building frame constructed using my building system, employing peak, rafter and eave connectors, a center column, and illustrating the deployment of girts, window openings and door openings.
Figure 55:
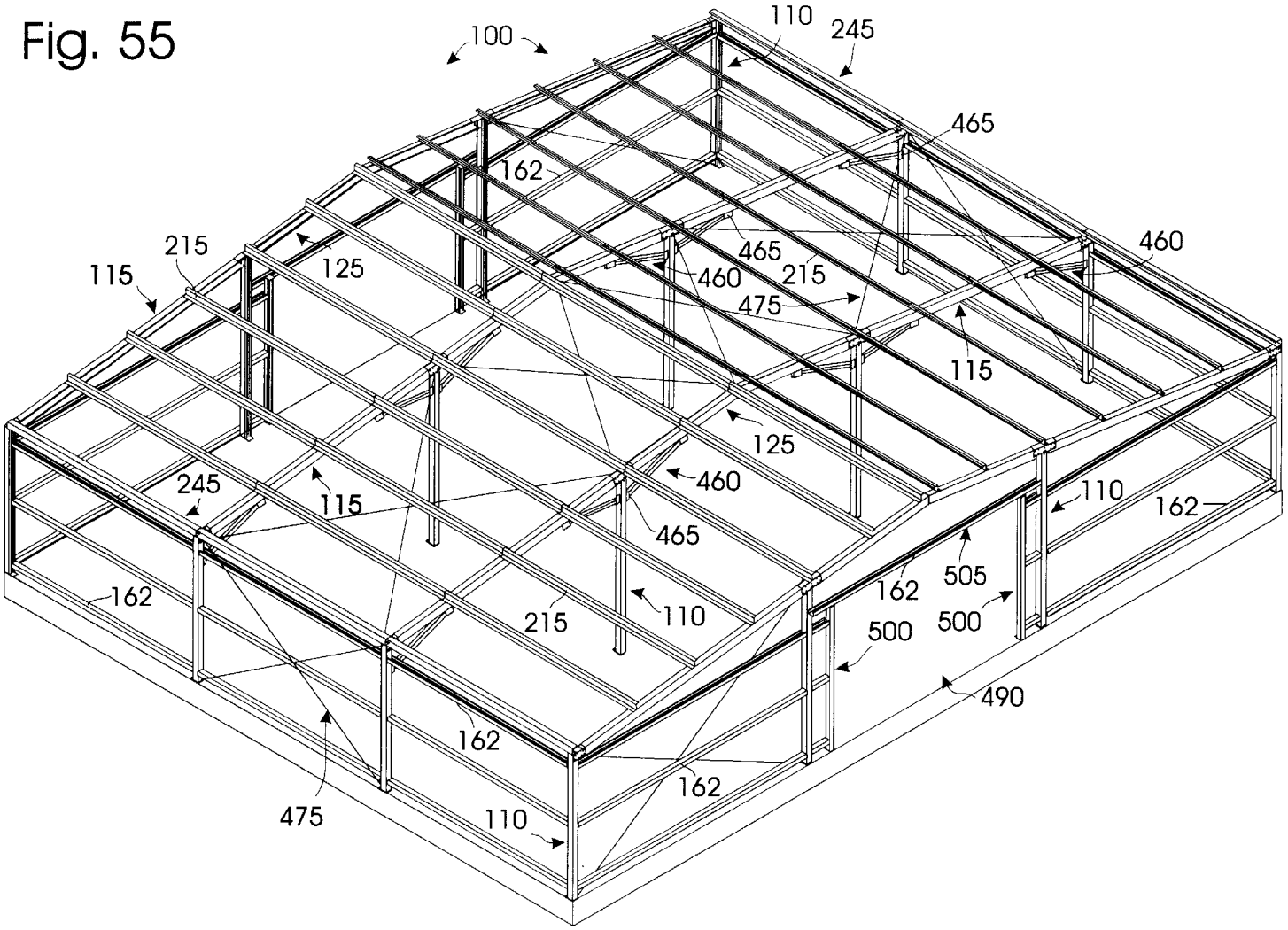
Figure 56:
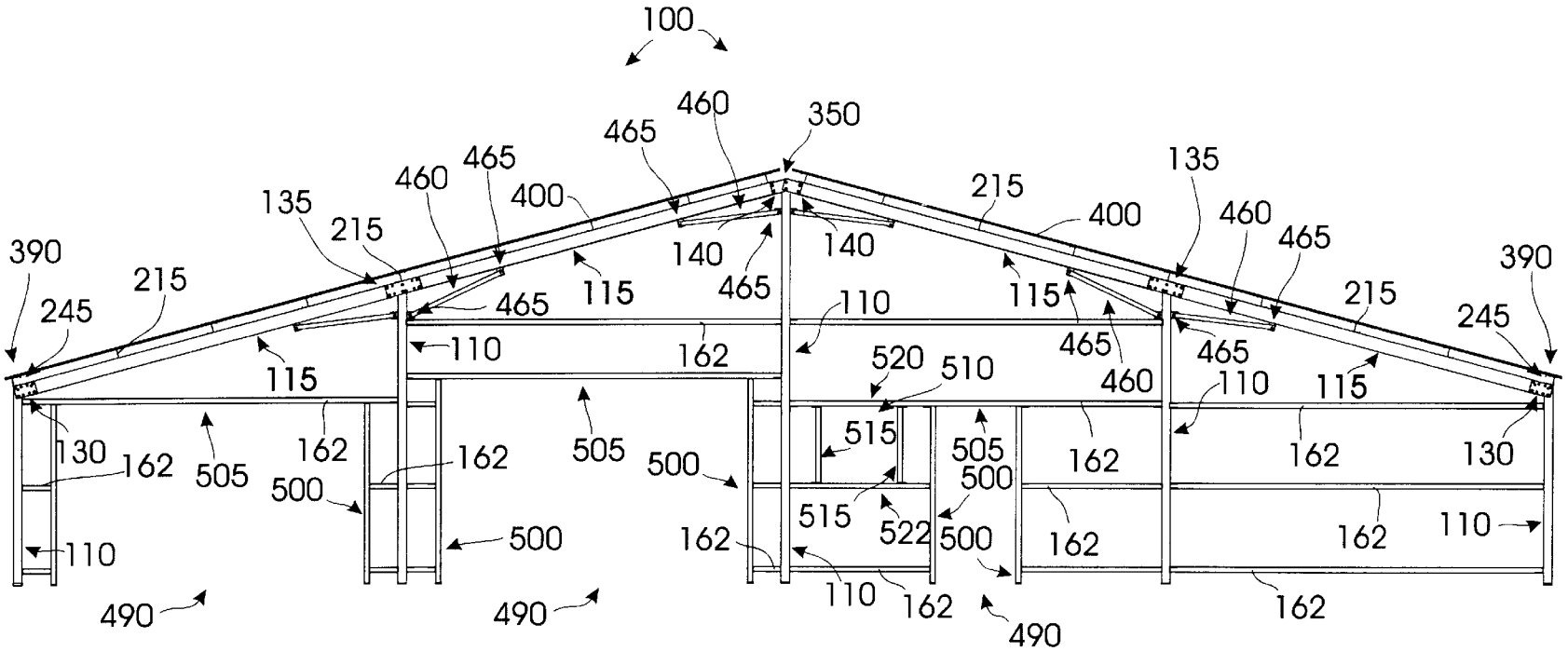

An alternative embodiment of the system 100 calls for diagonal attachment of generally square tubular steel kicker braces 460 on interior main frames. See FIGS. 53 and 55 These kickers 460 will greatly enhance rafter load capabilities. The thickness and length of kickers 460 are determined by required load conditions. Universal angle brackets 465 are utilized to secure kickers from columns 110 to rafters 115. Alternatively, kicker braces 460 may be attached to columns 110 and rafters 115, 120 and 125 by plates welded on each end of the kicker brace 460 and secured with self tapping screws.

Alternative X-bracing 475, comprised of stainless steel cables 480 with turn buckles or "I" bolts, can be utilized in the present modular building system 100, with appropriate bracing at the end walls, side walls and roof. See FIG. 55. Flat steel straps 485 can be utilized for X-bracing 475 in bays containing overhead door or walk door openings 490. These straps are attached to main frame columns 110 and framed openings 485 and 490 using self tapping drill screws 495. See FIG. 54.

All framed openings 490 in this system 100 utilize "C" tubing as side, vertical framing 500, with girts 162 utilized as door headers 505. Framing 500 forming the side of an opening have pre-punched base plates for anchor bolt attachment and pre-welded header plates for attachment to headers 505 using self tapping drill screws. Thusly, overhead doors are centered in bays, walk doors may be placed in the center of bays or to either side. See FIGS. 47 through 52 and FIG. 54. Window framed openings 510 utilize "C" members as window side frames 515 and installed girts 162 as headers 520 and sills 522. This allows for window 510 placement at the builder's discretion.

Exterior sheathing 400 for my lightweight pre-engineered prefabricated modular building system 100 may be of any metal or aluminum panel configuration or wood products and siding. Preferably skin 400 and trim is attached with self taping drill screws using neoprene washers. Vinyl backed fiberglass insulation can be anchored between the frame members the outer skin.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense. For example, the use of various sizes of members is anticipated as well as the use of numerous building materials including but not limited to steel, wood, aluminum and composites.

What is claimed is:

1. A lightweight pre-engineered prefabricated modular building system comprising:

a plurality of principal structural member columns, said principal structural members comprising a generally tubular body, an upper extent of said columns defining a pair of vertically spaced apart orifices and a base plate extending generally perpendicularly from a lower extent of said body, generally horizontally, said base plate defining at least one anchor orifice;

a plurality of rafters, each of said rafters extending between two of said columns;

an eave connector joining each of said rafters to a one of said columns, said eave connector comprising:

a pivot hole to receive a pivot bolt to pivotally mount said eave connector to said upper extent of said column and an elongated pitch slot to receive a pitch bolt, said eave connector pivoted about said pivot bolt to selectively align said pitch bolt in an outside portion of said pitch slot for a steep pitch roof building and an inside potion of said pitch slot for a shallow pitch roof building; and, a plurality of spaced apart shallow pitch rafter mounting orifices and a plurality of steep pitch orifices selectively receiving rafter mounting bolts;

a plurality of column peak connectors, each joining one of said rafters and one of said columns, each of said column peak connectors comprising:

a pivot hole to receive a pivot bolt to pivotally mount said peak column connector to said upper extent of a column and an elongated pitch slot to receive a pitch bolt, said pitch slot selectively receiving said pitch bolt in an outside portion of said pitch slot for a steep pitch roof building and an inside potion of said pitch slot for a shallow pitch roof building; and, a plurality of spaced apart steep pitch rafter orifices defined near on outside extent of said column peak connector and a pair of spaced apart shallow pitch rafter orifices spaced toward a center of said column peak connector from said steep pitch rafter orifices for selectively receiving rafter bolts to secure a rafter to said peak column connector in steep and shallow pitches; and, exterior sheathing mounted to said columns and rafters.

2. The lightweight pre-engineered prefabricated modular building system as defined in claim 1 wherein one of said eave connector steep pitch rafter orifices is an unused pitch slot.

3. The lightweight pre-engineered prefabricated modular building system as defined in claim 2 wherein said principal structural members have a generally "C" shaped cross-section, said body of said principal structural members comprising a longitudinal notch.

4. The lightweight pre-engineered prefabricated modular building system as defined in claim 3 further comprising an eave peek strut, said eave peak strut comprising an elongated generally tubular body having an angled side with an opposite open face, an upper portion defining a lip extending into said open face and a lower portion, said eave peak strut mounted to an eave peak strut orifice defined in a generally perpendicular top portion of said eave connector with said angled side of said eave peak strut facing outward.

5. The lightweight pre-engineered prefabricated modular building system as defined in claim 4 further comprising an eave peek strut mounted to an eave peak strut mounting orifice defined in a generally perpendicular top portion of said peak connector with said angled side of said eave peak strut facing outward.

6. The lightweight pre-engineered prefabricated modular building system as defined in claim 5 further comprising a plurality of mirror image column peak connectors each of said mirror image column peak connectors secured to an upper extent of said column to which a column peak connector is secured, using said peak connector pivot and pitch bolts and an eave connector and eave column spaced apart from first said eave connector and said eave column forming a double pitch building frame.

7. The lightweight pre-engineered prefabricated modular building system as defined in claim 6, further comprising a rafter connector to join rafters between said eave connector and said peak connector, said rafter connector comprising:

a pivot hole defined in a center portion of said rafter connector, near a top edge, to receive a pivot bolt to pivotally mount said rafter connector to said upper extent of a column;

a pair elongated pitch slots spaced apart from and below said pivot hole, an outside most pitch slot receiving a pitch bolt, said rafter connector pivoted about said pivot bolt to selectively align said pitch bolt in an outside portion of said outside most pitch slot for a steep pitch roof building and an inside potion of said outside most pitch slot for a shallow pitch roof building; and, a plurality of spaced apart steep pitch orifices near each end of said rafter connector and a plurality of shallow pitch orifices spaced toward a center of said face plate portion from said steep pitch orifices for selectively receiving rafter bolts to secure a rafter to said rafter connectors in shallow and a steep pitches.

8. The lightweight pre-engineered prefabricated modular building system as defined in claim 7 further comprising elongated purlins having a generally "Z" shaped cross section, said purlins extending between and generally perpendicular to said rafters to secure roof sheathing to a building in said building system; and, said rafter connectors comprising a generally perpendicular top plate portion, said top plate portion defining at least one purlin attachment orifice.

9. The lightweight pre-engineered prefabricated modular building system as defined in claim 8 further comprising generally "C" shaped girts extending generally perpendicularly between exterior columns to secure side wall sheathing to a building in said building system.

10. The lightweight pre-engineered prefabricated modular building system as defined in claim 9 further comprising a column stiffener secured to each of said principal structural member columns, said stiffener comprising:

an elongated body portion having a generally "V" shaped cross-section, said elongated body portion defining an apex; and elongated flange portions extending outwardly from said elongated body portion, spaced apart from said apex, said flange portions secured to said column with said apex disposed within said notch defined by said principal structural member.

11. A lightweight pre-engineered prefabricated modular building system comprising:

a plurality of principal structural member columns comprising a generally tubular body, an upper extent of said columns defining a pair of vertically spaced apart orifices and a base plate extending generally perpendicularly from a lower extent of said body, generally horizontally, said base plate defining at least one anchor orifice;

a plurality of rafters, each of said rafters extending between two of said columns;

an eave connector joining each of said rafters to a one of said columns, said eave connector comprising:

a pivot hole to receive a pivot bolt to pivotally mount said eave connector to said upper extent of said column and an elongated pitch slot to receive a pitch bolt, said eave connector pivoted about said pivot bolt to selectively align said pitch bolt in an outside portion of said pitch slot for a steep pitch roof building and an inside potion of said pitch slot for a shallow pitch roof building; and, a plurality of spaced apart shallow pitch rafter mounting orifices and a plurality of steep pitch orifices selectively receiving rafter mounting bolts;

a plurality of column peak connectors, each joining one of said rafters and one of said columns, each of said column peak connectors comprising:

a pivot hole to receive a pivot bolt to pivotally mount said peak column connector to said upper extent of a column and an elongated pitch slot to receive a pitch bolt, said pitch slot selectively receiving said pitch bolt in an outside portion of said pitch slot for a steep pitch roof building and an inside potion of said pitch slot for a shallow pitch roof building; and, a plurality of spaced apart steep pitch rafter orifices defined near on outside extent of said column peak connector and a pair of spaced apart shallow pitch rafter orifices spaced toward a center of said column peak connector from said steep pitch rafter orifices for selectively receiving rafter bolts to secure a rafter to said peak column connector in steep and shallow pitches;

a plurality of mirror image peak connectors, each of said mirror image peak connectors secured to an upper extent of said column mounting one of said peak connectors using said peak connector pivot and pitch bolts; and, exterior sheathing mounted to said columns and rafters.

12. The lightweight pre-engineered prefabricated modular building system as defined in claim 11 further comprising a rafter connector to join rafters between said eave connector and said peak connector, said rafter connector comprising:

a pivot hole defined in a center portion of said rafter connector, near a top edge, to receive a pivot bolt to pivotally mount said rafter connector to said upper extent of a column;

a pair elongated pitch slots spaced apart from and below said pivot hole, an outside most pitch slot receiving a pitch bolt, said rafter connector pivoted about said pivot bolt to selectively align said pitch bolt in an outside portion of said outside most pitch slot for a steep pitch roof building and an inside potion of said outside most pitch slot for a shallow pitch roof building; and, a plurality of spaced apart steep pitch orifices near each end of said rafter connector and a plurality of shallow pitch orifices spaced toward a center of said face plate portion from said steep pitch orifices for selectively receiving rafter bolts to secure a rafter to said rafter connectors in shallow and a steep pitches.

13. The lightweight pre-engineered prefabricated modular building system as defined in claim 12 wherein one of said eave connector steep pitch rafter orifices is an unused pitch slot.

14. The lightweight pre-engineered prefabricated modular building system as defined in claim 13 wherein said principal structural members have a generally "C" shaped cross-section, said body of said principal structural members comprising a longitudinal notch.

15. The lightweight pre-engineered prefabricated modular building system as defined in claim 14 further comprising an eave peek strut, said eave peak strut comprising an elongated generally tubular body having an angled side with an opposite open face, an upper portion defining a lip extending into said open face and a lower portion, said eave peak strut mounted to an eave peak strut orifice defined in a generally perpendicular top portion of said eave connector with said angled side of said eave peak strut facing outward.

16. The lightweight pre-engineered prefabricated modular building system as defined in claim 15 further comprising elongated purlins having a generally "Z" shaped cross section, said purlins extending between and generally perpendicular to said rafters to secure roof sheathing to a building in said building system; and, said rafter connectors comprising a generally perpendicular top plate portion, said top plate portion defining at least one purlin attachment orifice.

17. The lightweight pre-engineered prefabricated modular building system as defined in claim 16 further comprising generally "C" shaped girts extending generally perpendicularly between exterior columns to secure side wall sheathing to a building in said building system.

18. The lightweight pre-engineered prefabricated modular building system as defined in claim 17 further comprising a column stiffener secured to each of said principal structural member columns, said stiffener comprising:

an elongated body portion having a generally "V" shaped cross-section, said elongated body portion defining an apex; and elongated flange portions extending outwardly from said elongated body portion, spaced apart from said apex, said flange portions secured to said column with said apex disposed within said notch defined by said principal structural member.

* * * * *